US010281146B1

(12) United States Patent
Swanson et al.

(10) Patent No.: US 10,281,146 B1
(45) Date of Patent: May 7, 2019

(54) APPARATUS AND METHOD FOR A CENTER FUEL STABILIZATION BLUFF BODY

(71) Applicants: Michael Swanson, Chickamauga, GA (US); Malcolm Swanson, Chickamauga, GA (US); Ricardo Costa, Miami, FL (US); Theodore Warren Glassmire, Soddy Daisy, TN (US)

(72) Inventors: Michael Swanson, Chickamauga, GA (US); Malcolm Swanson, Chickamauga, GA (US); Ricardo Costa, Miami, FL (US); Theodore Warren Glassmire, Soddy Daisy, TN (US)

(73) Assignee: Astec, Inc., Chattanooga, TN (US)

( * ) Notice: Subject to any disclaimer, the term of this patent is extended or adjusted under 35 U.S.C. 154(b) by 1439 days.

(21) Appl. No.: 13/865,513

(22) Filed: Apr. 18, 2013

(51) Int. Cl.
*F23D 17/00* (2006.01)
*F23D 14/46* (2006.01)
*F23D 14/62* (2006.01)

(52) U.S. Cl.
CPC ..... *F23D 17/002* (2013.01); *F23D 14/46* (2013.01); *F23D 14/62* (2013.01)

(58) Field of Classification Search
USPC ..... 431/8, 9
See application file for complete search history.

(56) References Cited

U.S. PATENT DOCUMENTS 1,808,120 A * 6/1931 Runkwitz ..... F23D 1/00 110/104 R
3,213,918 A * 10/1965 Rudzki ..... F23D 17/00 239/106
3,273,621 A * 9/1966 Childree ..... F23D 17/00 431/238
3,615,053 A * 10/1971 Pease et al. ..... F23D 11/22 239/399
3,748,111 A * 7/1973 Klose ..... A62C 4/00 220/88.2
3,880,571 A * 4/1975 Koppang ..... F23D 14/00 431/8
3,894,834 A * 7/1975 Estes ..... F23C 1/12 110/185
4,257,762 A * 3/1981 Zink ..... F23D 14/02 239/424.5
4,416,620 A * 11/1983 Morck ..... F23D 14/24 239/403

(Continued)

*Primary Examiner* — Avinash A Savani
*Assistant Examiner* — Martha M Becton
(74) *Attorney, Agent, or Firm* — Chambliss, Bahner & Stophel, P.C.

(57) ABSTRACT

An apparatus for producing a stabilizing base flame for a premix main burner flame in a burner assembly having a burner end, a first fuel line, a first fuel nozzle, a second fuel line, and a second fuel nozzle. The apparatus comprises a conduit having a first fuel line end in fluid communication with the first fuel line, a second fuel line end in fluid communication with the second fuel line, a valve in fluid communication with the conduit and a center fuel stabilization bluff body mounted in the burner end. The center fuel stabilization bluff body comprises a first ring, a second ring and a cylinder disposed between the first ring and the second ring.

14 Claims, 26 Drawing Sheets

(56) References Cited

U.S. PATENT DOCUMENTS 4,925,387 A * 5/1990 Locanetto ..... F23C 6/047 431/187
5,049,066 A * 9/1991 Kaiya ..... F23D 14/00 431/187
5,415,539 A * 5/1995 Musil ..... F23C 7/004 239/404
5,636,977 A * 6/1997 Benson ..... F23C 6/047 431/115
5,984,665 A * 11/1999 Loftus ..... F23C 6/047 239/548
6,238,206 B1 * 5/2001 Cummings, III ..... F23D 14/24 431/10
6,272,840 B1 * 8/2001 Crocker ..... F02C 7/22 239/404
6,652,268 B1 * 11/2003 Irwin ..... F23D 14/36 431/115
6,694,743 B2 * 2/2004 Lawlor ..... F01D 1/026 60/39.34
7,658,075 B2 * 2/2010 von der Bank ..... F23D 11/107 60/737
7,785,100 B1 * 8/2010 Swanson ..... F23D 14/36 431/181
7,878,797 B1 * 2/2011 Swanson ..... F23D 14/36 431/181
8,337,197 B2 * 12/2012 Poe ..... F23D 14/08 137/833
8,646,275 B2 * 2/2014 Rackwitz ..... F23R 3/343 60/737
9,841,189 B2 * 12/2017 Wartluft ..... F23D 14/36
2003/0148236 A1 * 8/2003 Joshi ..... F23C 5/32 431/9
2005/0028526 A1 * 2/2005 Von Der Bank ..... F23R 3/18 60/748
2006/0147854 A1 * 7/2006 Fullemann ..... F23C 6/045 431/9
2006/0248898 A1 * 11/2006 Buelow ..... F23R 3/14 60/776
2007/0292811 A1 * 12/2007 Poe ..... F23D 14/08 431/116
2008/0280243 A1 * 11/2008 Swanson ..... F23D 11/001 431/254
2009/0111063 A1 * 4/2009 Boardman ..... F23R 3/14 431/8
2009/0181333 A1 * 7/2009 Feese ..... F23C 6/045 431/9
2009/0211257 A1 * 8/2009 Cankovic ..... F02C 3/20 60/740
2009/0226852 A1 * 9/2009 Feese ..... F23C 7/006 431/9
2010/0216079 A1 * 8/2010 Targoff ..... F23D 11/441 431/8
2011/0117506 A1 * 5/2011 Poe ..... F23D 14/08 431/8
2013/0168470 A1 * 7/2013 Olver ..... F23D 1/00 239/397.5
2014/0308619 A1 * 10/2014 Wartluft ..... F23D 14/36 431/9

* cited by examiner

APPARATUS AND METHOD FOR A CENTER FUEL STABILIZATION BLUFF BODY

CROSS-REFERENCES TO RELATED PATENT APPLICATIONS

This application is a continuation-in-part application relating back to and claiming the benefit of priority from U.S. Provisional Application for Patent No. 61/687,098 filed on Apr. 18, 2012 and entitled "Apparatus and Method for a Bluff Body," U.S. patent application Ser. No. 13/373,339 filed on Nov. 10, 2011 and entitled "Apparatus and Method for a Center Fuel Stabilization Bluff Body," U.S. patent application Ser. No. 12/218,556 filed on Jul. 16, 2008 and entitled "Apparatus and Method of a Center Fuel Stabilization Bluff Body" and U.S. patent application Ser. No. 11/098,157 filed on Apr. 4, 2005 and entitled "Apparatus and Method for a Stabilizing Base Flame."

FIELD OF THE INVENTION

The present invention relates generally to burner assemblies, and particularly to an apparatus and method for producing a stabilizing base flame for a premix main burner flame in premix burner assemblies adapted to selectively fire on gaseous fuel and liquid fuel, particulate solid fuel or any combination thereof.

BACKGROUND AND DESCRIPTION OF THE PRIOR ART

It is known to employ a burner assembly to produce a burner flame for the purpose of drying aggregate materials such as those that are used in the production of hot mix asphalt ("HMA"). However, conventional burner assemblies suffer from several disadvantages. For example, conventional premix burner assemblies have inherent burner flame stability problems, particularly in the lower portion of the range of operation of the burner flame. In addition, conventional premix burner assemblies experience undesirable flashbacks by the burner flame which occur when the burner flame propagates back up from the burner end of the burner assembly into the body of the burner assembly.

It would be desirable, therefore, if an apparatus and method could be provided that would produce a stabilizing base flame for the premix main burner flame in a burner assembly. It would also be desirable if such an apparatus and method could be provided that would improve the stability of the premix main burner flame in a burner assembly, particularly in the lower portion of the range of operation of the premix main burner flame. It would be further desirable if such an apparatus and method could be provided that would reduce the incidence of undesirable flashbacks and blow offs by the premix main burner flame. It would be still further desirable if such an apparatus and method could be provided that would enhance the mixing of stabilizing base flame fuel with main combustion air so that the stabilizing base flame may be run throughout the entire firing range of the burner without adversely affecting the quality of the combustion emissions. It would also be desirable if such an apparatus and method could be provided that would enhance the stabilizing characteristics of the premix stabilization base flame and enable the combustion of leaner premix gas mixtures, thereby improving the stability of the base flame so that it may be run safely throughout the entire firing range of the burner, including higher main flame ranges with very lean mixtures. It would be further desirable if such an apparatus and method could be provided that would produce a symmetrical center base flame pattern that fills any vortices produced by the main flame and improves the shape of the main flame.

Advantages of the Preferred Embodiments of the Invention

Accordingly, it is an advantage of the preferred embodiments of the invention claimed herein to provide an apparatus and method for producing a stabilizing base flame for the premix main burner flame in a burner assembly. It is also an advantage of the preferred embodiments of the invention claimed herein to provide an apparatus and method for improving the stability of the premix main burner flame in a burner assembly, particularly in the lower portion of the range of operation of the premix main burner flame. It is a further advantage of the preferred embodiments of the invention claimed herein to provide an apparatus and method for reducing the incidence of undesirable flashbacks and blow offs by the premix main burner flame. It is another advantage of the preferred embodiments of the invention claimed herein to provide an apparatus and method for enhancing the mixing of stabilizing base flame fuel with main combustion air so that the stabilizing base flame may be run throughout the entire firing range of the burner without adversely affecting the quality of the combustion emissions. It is yet another advantage of the preferred embodiments of the invention claimed herein to provide an apparatus and method for enhancing the stabilizing characteristics of the premix stabilization base flame and enabling the combustion of leaner premix gas mixtures, thereby improving the stability of the base flame so that it may be run safely throughout the entire firing range of the burner, including higher main flame ranges with very lean mixtures. It is still another advantage of the preferred embodiments of the invention claimed herein to provide an apparatus and method for producing a symmetrical center base flame pattern that fills any vortices produced by the main flame and improves the shape of the main flame.

Additional advantages of the invention will become apparent from an examination of the drawings and the ensuing description.

Explanation of Technical Terms

As used herein, the term "bluff body" refers to any device, mechanism, assembly or combination thereof that is adapted to enhance the mixing of stabilizing base flame fuel with main combustion air, enhance the stabilizing characteristics of the premix stabilization base flame, produces a symmetrical center base flame pattern that fills any vortices produced by the main flame and/or improves the shape of the main flame. The term "bluff body" includes, without limitation, discs, rings and cylinders.

As used herein, the term "burner control system" refers to any system capable of achieving a pre-specified or desired performance or result from a burner assembly or any portion or subassembly thereof. The term "burner control system" may include a closed-loop system which derives its commands from measurements of the performance characteristics of the burner assembly or a portion or subassembly thereof which is being controlled. The term "burner control system" may also include a computer having software adapted to receive input data such as from the measurements of one or more performance characteristics of the burner assembly and integrate the input data in order to produce output commands which control one or more performance characteristics of the burner assembly. It is contemplated within the scope of the term "burner control system", however, that such term does not require a closed-loop system, a computer or software.

As used herein, the terms "main flame", "premix main flame", "burner flame", "main burner flame" and "premix main burner flame" refer to the primary flame produced by a burner assembly for drying materials such as aggregate materials used in the production of hot mix asphalt. The terms "main flame", "premix main flame", "burner flame", "main burner flame" and "premix main burner flame" include primary flames which are produced by gaseous fuel, liquid fuel, particulate solid fuel or any combination thereof.

As used herein, the term "conduit" refers to any pipe, tube, hose, channel, manifold, fitting, groove, depression, course, path or passageway through which materials such as gases, liquids and/or particulate solids may pass.

As used herein, the term "fuel line" refers to any pipe, tube, hose, channel, manifold, fitting, groove, depression, course, path or passageway through which materials such as gases, liquids and/or particulate solids may pass.

As used herein, the term "fuel nozzle" refers to any device adapted to convey gaseous fuel, liquid fuel, particulate solid fuel or any combination thereof from the interior of a fuel line to the exterior of the fuel line. The term "fuel nozzle" includes, but is not limited to, one or more holes, apertures, vents or other openings located in a fuel line, as that term is defined herein. The term "fuel nozzle" also includes, but is not limited to, devices that are capable of atomizing or entraining liquid or solid materials.

As used herein, the term "valve" refers to any device that is capable of controlling the flow of material in a conduit or fuel line, as those terms are defined above. The term "valve" includes, but is not limited to, manual valves which are adapted to manually control the flow of material in a conduit or fuel line and automatic valves which are adapted to automatically control the flow of material in a conduit or fuel line. The term "valve" includes, but is not limited to, automatic valves that are controlled by a burner control system, as that term is defined above, in order to automatically control the flow of material in a conduit or fuel line.

SUMMARY OF THE INVENTION

The invention comprises an apparatus for producing a stabilizing base flame for a premix main burner flame in a burner assembly having a burner end, a first fuel line, a first fuel nozzle in fluid communication with the first fuel line, a second fuel line, and a second fuel nozzle in fluid communication with the second fuel line. The apparatus comprises a conduit having a first fuel line end in fluid communication with the first fuel line, a second fuel line end in fluid communication with the second fuel line, a valve in fluid communication with the conduit and a center fuel stabilization bluff body mounted in the burner end. The preferred center fuel stabilization bluff body comprises a first ring, a second ring and a cylinder. The first fuel line is adapted to convey fuel to the first fuel nozzle in order to produce a premix main burner flame in the burner end of the burner assembly. The conduit is adapted to convey fuel from the first fuel line to the second fuel line in order to produce a stabilizing base flame near the second fuel nozzle of the burner assembly.

In a preferred embodiment of the invention, the apparatus for producing a stabilizing base flame for a premix main burner flame is adapted for use in a premix burner assembly having a burner end, a gaseous fuel line for conveying gaseous fuel, at least one gaseous fuel nozzle in fluid communication with the gaseous fuel line, a liquid fuel line for conveying liquid fuel, at least one liquid fuel nozzle in fluid communication with the liquid fuel line, and a burner control system. In the preferred embodiment, the apparatus comprises a conduit having a gaseous fuel line end which is in fluid communication with the gaseous fuel line of the burner assembly and a liquid fuel line end which is in fluid communication with the liquid fuel line of the burner assembly. Also in the preferred embodiment, the apparatus comprises a manual valve in fluid communication with the conduit. The manual valve is preferably located between the gaseous fuel line end of the conduit and the liquid fuel line end of the conduit and preferably adapted to manually control the flow of gaseous fuel through the conduit. The preferred embodiment also comprises an automatic valve in fluid communication with the conduit. The automatic valve is preferably located between the gaseous fuel line end of the conduit and the liquid fuel line end of the conduit and downstream from the manual valve. In the preferred embodiment, the automatic valve is adapted to be automatically controlled by the burner control system.

Still referring to a preferred embodiment of the apparatus, the gaseous fuel line is adapted to convey to the at least one gaseous fuel nozzle a first portion of the gaseous fuel conveyed by the gaseous fuel line of the burner assembly in order to produce a premix main burner flame in the burner end of the burner assembly. Also in the preferred embodiment, the conduit is adapted to convey to the liquid fuel line of the burner assembly a second portion of gaseous fuel conveyed by the gaseous fuel line of the burner assembly, and the second portion of gaseous fuel conveyed by the conduit from the gaseous fuel line to the liquid fuel line of the burner assembly is further conveyed to the at least one liquid fuel nozzle of the burner assembly in order to produce a stabilizing base flame for the premix main burner flame in the burner assembly.

The invention also comprises a method for producing a stabilizing base flame in a burner assembly having a burner end, a first fuel line, a first fuel nozzle in fluid communication with the first fuel line, a second fuel line, and a second fuel nozzle in fluid communication with the second fuel line. The method includes providing an apparatus for producing a stabilizing base flame for a premix main burner flame. The apparatus comprises a conduit in fluid communication with the first fuel line and the second fuel line, a valve in fluid communication with the conduit and a center fuel stabilization bluff body mounted in the burner end. The preferred center fuel stabilization bluff body comprises a first ring, a second ring and a cylinder. The first fuel line is adapted to convey fuel to the first fuel nozzle in order to produce a premix main burner flame in the burner end of the burner assembly. The conduit is adapted to convey fuel from the first fuel line to the second fuel line in order to produce a stabilizing base flame near the second fuel nozzle of the burner assembly. The method also includes conveying a first portion of fuel from the first fuel line to the first fuel nozzle of the burner assembly, conveying a second portion of fuel from the first fuel line of the burner assembly to the conduit, conveying the second portion of fuel from the conduit to the second fuel line of the burner assembly, conveying the second portion of fuel from the second fuel line of the burner assembly to the second fuel nozzle of the burner assembly, and igniting the first portion of fuel conveyed to the first fuel nozzle of the burner assembly and the second portion of fuel conveyed to the second fuel nozzle of the burner assembly.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
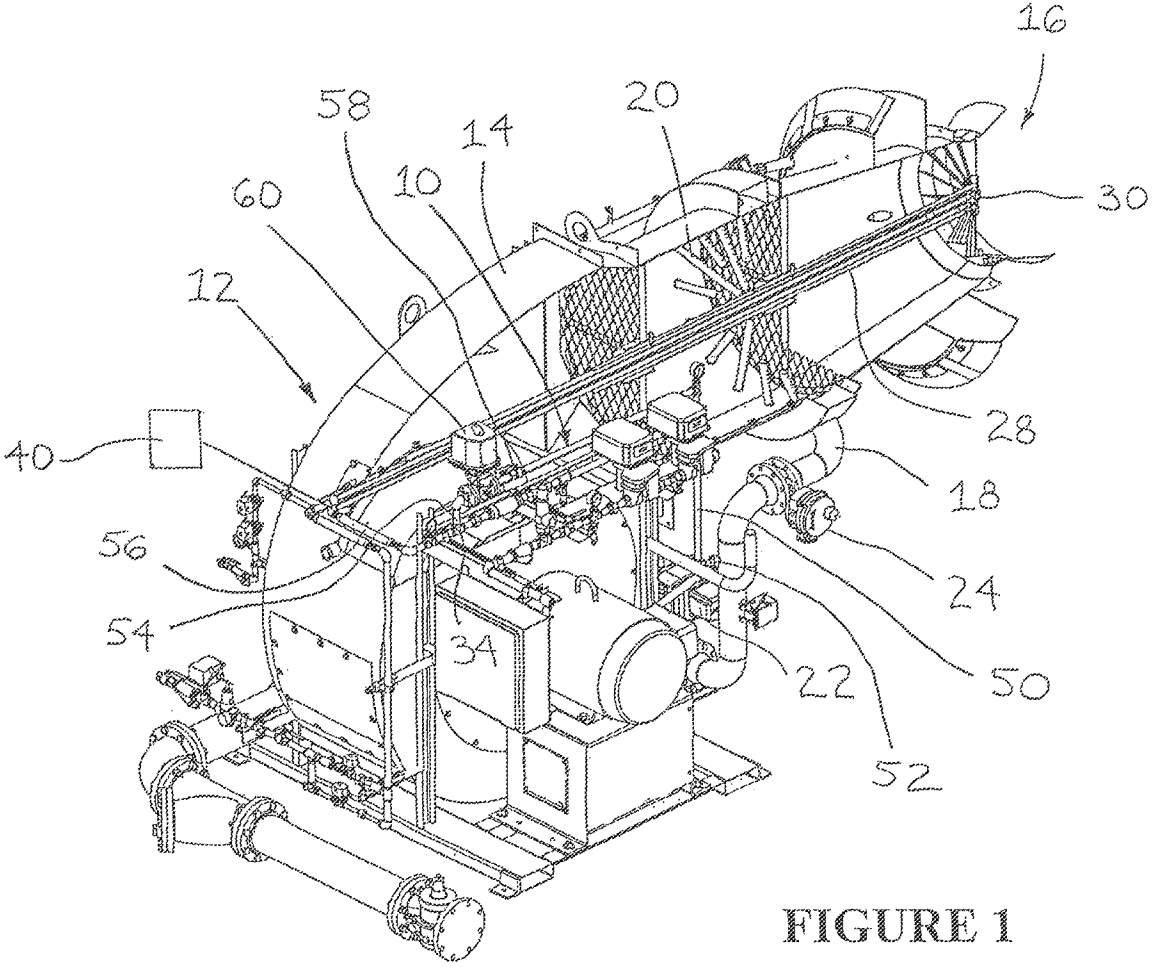
FIG. 1 is a partial sectional perspective view of the preferred embodiment of the apparatus for producing a stabilizing base flame assembled to an exemplary burner assembly.

Referring now to the drawings, the preferred embodiment of the apparatus and method for producing a stabilizing base flame for a premix main burner flame is illustrated by FIGS. 1 through 26. More particularly, FIG. 1 is a partial sectional perspective view of the preferred embodiment of the apparatus for producing a stabilizing base flame assembled to an exemplary burner assembly. As shown in FIG. 1, the preferred apparatus for producing a stabilizing base flame is designated generally by reference numeral 10 and the exemplary burner assembly is designated generally by reference numeral 12. Exemplary burner assembly 12 includes housing or body 14 in which fuel and air are mixed as they are conveyed toward burner end 16. A premix main burner flame is produced at burner end 16.

As shown in FIG. 1, exemplary burner assembly 12 also includes a first fuel line such as gaseous fuel line 18. The preferred gaseous fuel line 18 is in fluid communication with one or more first fuel nozzles such as gaseous fuel nozzles 20. The preferred gaseous fuel line 18 is adapted to convey gaseous fuel to the one or more gaseous fuel nozzles 20 in order to contribute to the production of the premix main burner flame. The preferred gaseous fuel line 18 includes gas safety shutoff valve 22 and throttling gas control valve 24 which are adapted to control the flow of gaseous fuel in the gaseous fuel line. The fuel conveyed to the one or more first fuel nozzles may be ignited by a pilot flame or the stabilizing base flame for the premix main burner flame.

Still referring to FIG. 1, exemplary burner assembly 12 further includes a second fuel line such as liquid fuel line 28. The preferred liquid fuel line 28 is in fluid communication with one or more second fuel nozzles such as liquid fuel nozzle 30. The preferred liquid fuel line 28 is adapted to convey liquid fuel to the one or more liquid fuel nozzles 30 in order to contribute to the production of the premix main burner flame. It is contemplated within the scope of the invention, however, that the second fuel line may be a fuel line that is adapted to convey gaseous fuel, liquid fuel, particulate solid fuel and any combination thereof. It is further contemplated that the one or more second fuel nozzles may be nozzles that are adapted to convey gaseous fuel, liquid fuel, particulate solid fuel and any combination thereof. It is still further contemplated that in a burner assembly that fires on only gaseous fuel, the second fuel nozzle may be a "dummy" nozzle such as one or more holes in the vicinity of the end of the second fuel line. The fuel conveyed to the one or more second fuel nozzles may be ignited by a pilot flame.

Referring still to FIG. 1, exemplary burner assembly 12 also preferably includes a purging line such as a compressed air line which may be connected at joint 34. The preferred purging line is in fluid communication with the second fuel line (such as liquid fuel line 28) and adapted to convey compressed air to the second fuel line in order to purge fuel from the second fuel line. It is contemplated within the scope of the invention, however, that the purging line may convey any suitable fluid, including but not limited to inert gases, to purge fuel from the second fuel line. The preferred purging line is adapted to automatically or manually purge fuel from the second fuel line. In a preferred embodiment, burner control system 40 (which is schematically represented) is adapted to automatically control the flow of fluid such as compressed air in the purging line such that fuel in the second fuel line may be automatically purged from the second fuel line. In the preferred embodiment, the burner control system causes the purging line to automatically purge fuel from the second fuel line before fuel from the conduit is conveyed to the second fuel line. As described in more detail below, the burner control system 40 may also automatically control several other components and functions of the preferred embodiments of the invention. It is also contemplated within the scope of the invention, however, that the purging line may be adapted to selectively purge fuel from the second fuel line such as, for example, when the conduit conveys gaseous fuel to a second fuel line which had been conveying heavy or waste oil. Indeed, it is generally acceptable to ignite the stabilizing base flame when the second fuel line contains liquid fuel inasmuch as the stabilizing base flame will transition from liquid fuel to gaseous fuel as gaseous fuel is conveyed by the conduit to the second fuel line and to the second fuel nozzle.

Referring now to FIGS. 1 through 4, the preferred apparatus for producing a stabilizing base flame 10 is illustrated. As shown in FIGS. 1 through 4, the preferred apparatus for producing a stabilizing base flame 10 includes conduit 50 having a first fuel line end such as gaseous fuel line end 52 which is in fluid communication with the first fuel line. Preferably, the gaseous fuel line end 52 of conduit 50 is connected to the gaseous fuel line 18 at a location between gas safety shutoff valve 22 and throttling gas control valve 24. More particularly, the preferred conduit 50 is connected to gaseous fuel line 18 of the burner assembly downstream from gas safety shutoff valve 22 and upstream from throttling gas control valve 24. The preferred conduit 50 also includes a second fuel line end such as liquid fuel line end 54 which is in fluid communication with the second fuel line. In a preferred embodiment, liquid fuel line end 54 of conduit 50 is connected to liquid fuel line 28 by train piping 56.

As shown in FIGS. 1 through 4, the preferred apparatus for producing a stabilizing base flame 10 also includes one or more valves such as manual ball valve 58 and automatic ball valve 60 which are in fluid communication with conduit 50 and adapted to control the flow of fuel in the conduit. More particularly, the preferred manual ball valve 58 is adapted to manually control the flow of fuel in the conduit, and the preferred automatic ball valve 60 is adapted to automatically control the flow of fuel in the conduit. The preferred valves are located between the first fuel line end and the second fuel line end of the conduit. While the drawings illustrate the preferred apparatus for producing a stabilizing base flame 10 as having a single manual valve and a single automatic valve located downstream from the manual valve, it is contemplated within the scope of the invention that more or less than one manual valve may be provided, more or less than one automatic valve may be provided, and the arrangement or location of the one or more valves may be modified to any suitable arrangement or location. It is further contemplated within the scope of the invention that a check valve or any other suitable valve may be provided along the conduit.

In a preferred embodiment, the one or more valves in fluid communication with the conduit are automatically controlled by burner control system 40. More particularly, the preferred burner control system 40 is adapted to permit the flow of fuel from the conduit to the second fuel line (and therefore produce a stabilizing base flame) only when the burner assembly is firing in the lower portion of the range of operation of the premix main burner flame. In another preferred embodiment, the burner control system is adapted to automatically permit the flow of fuel from the conduit to the second fuel line (and therefore produce a stabilizing base flame) in only the approximately lower one-third (⅓) portion of the range of operation of the premix main burner flame. The preferred burner control system 40 is also adapted to discontinue the flow of fuel from the conduit to the second fuel line when the burner assembly is not in operation.

Figure 2:
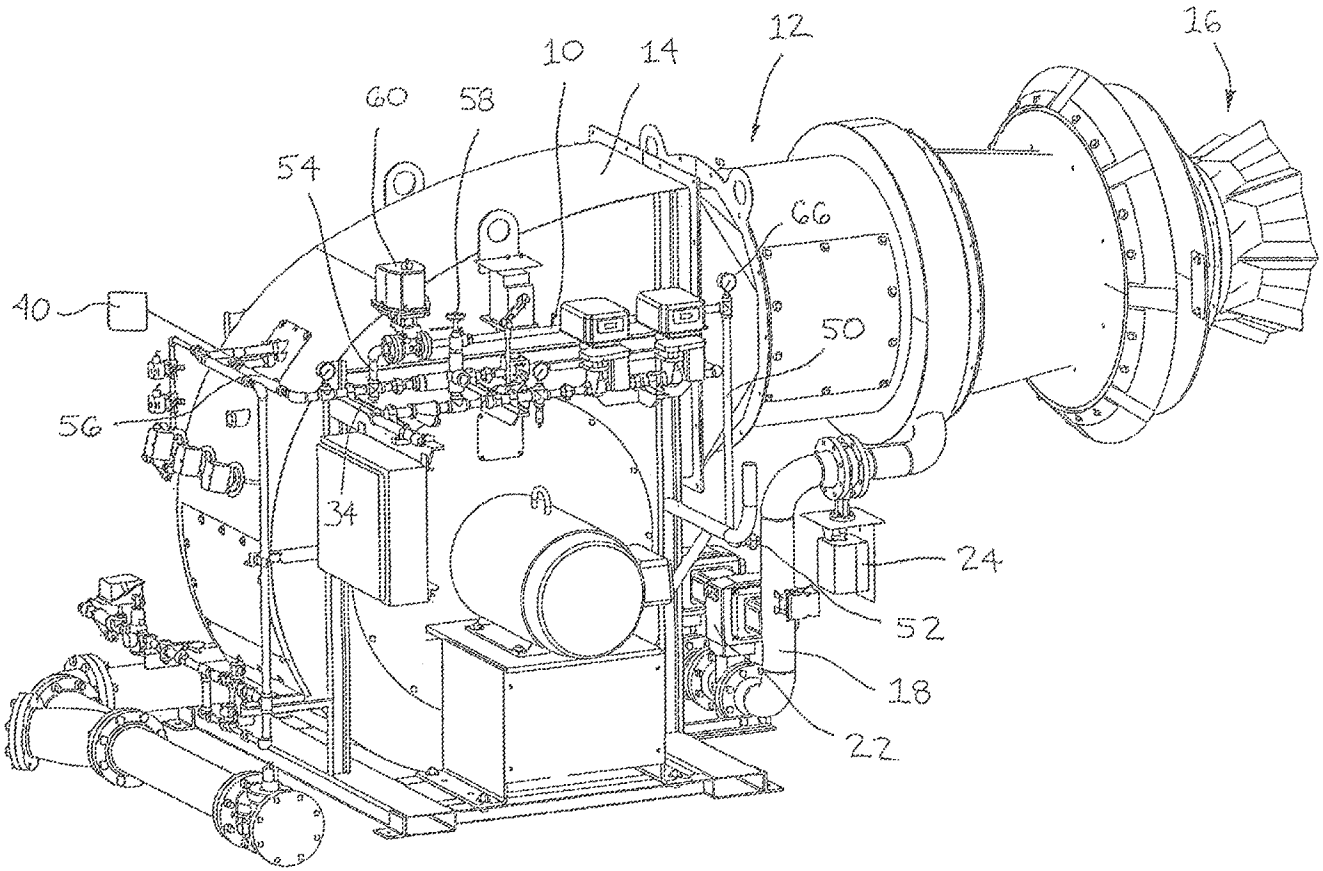
FIG. 2 is a perspective view of the preferred embodiment of the apparatus for producing a stabilizing base flame assembled to the exemplary burner illustrated in FIG. 1.
Figure 3:
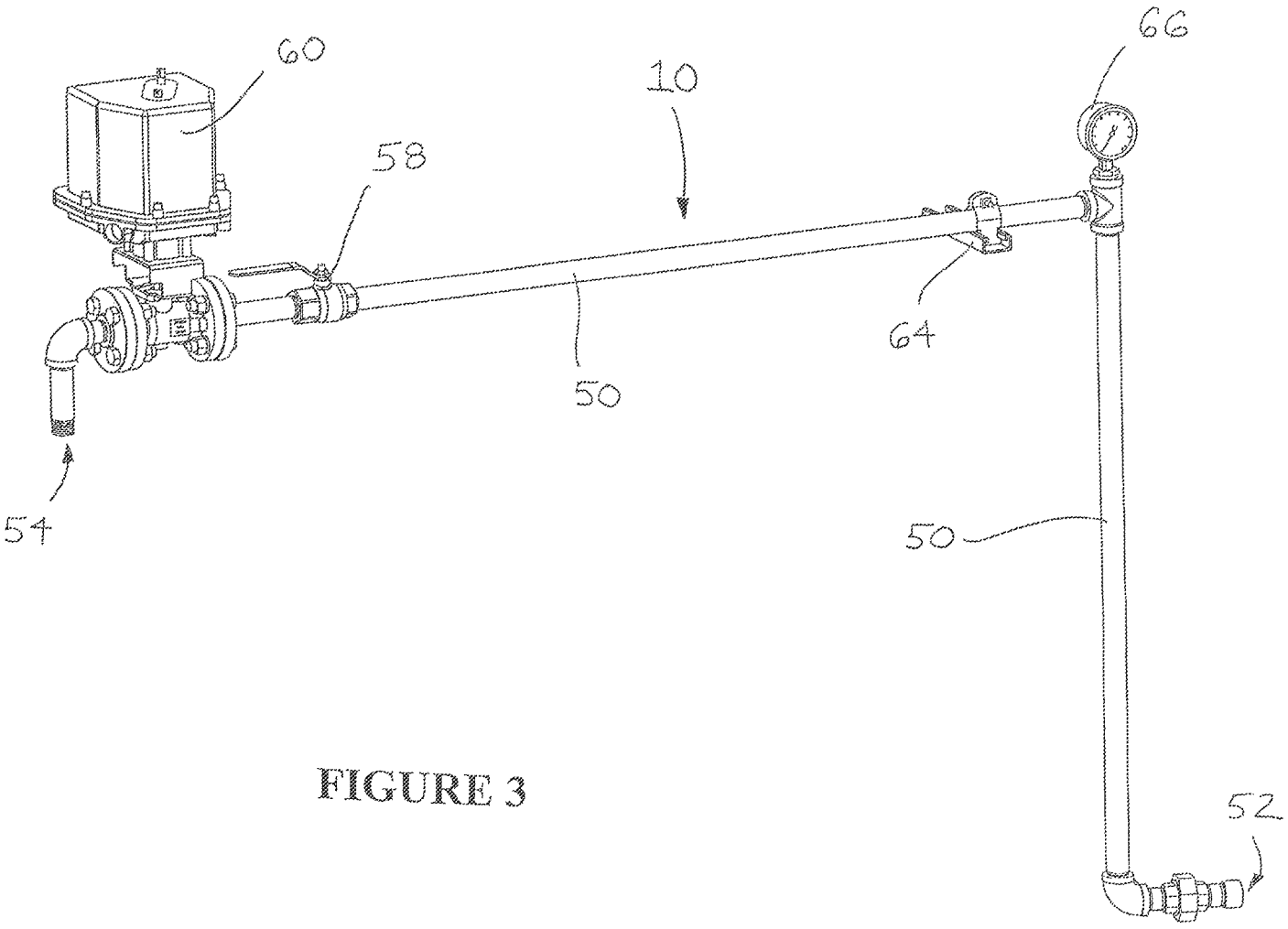
FIG. 3 is a perspective view of the preferred embodiment of the apparatus for producing a stabilizing base flame illustrated in FIG. 1.
Figure 4:
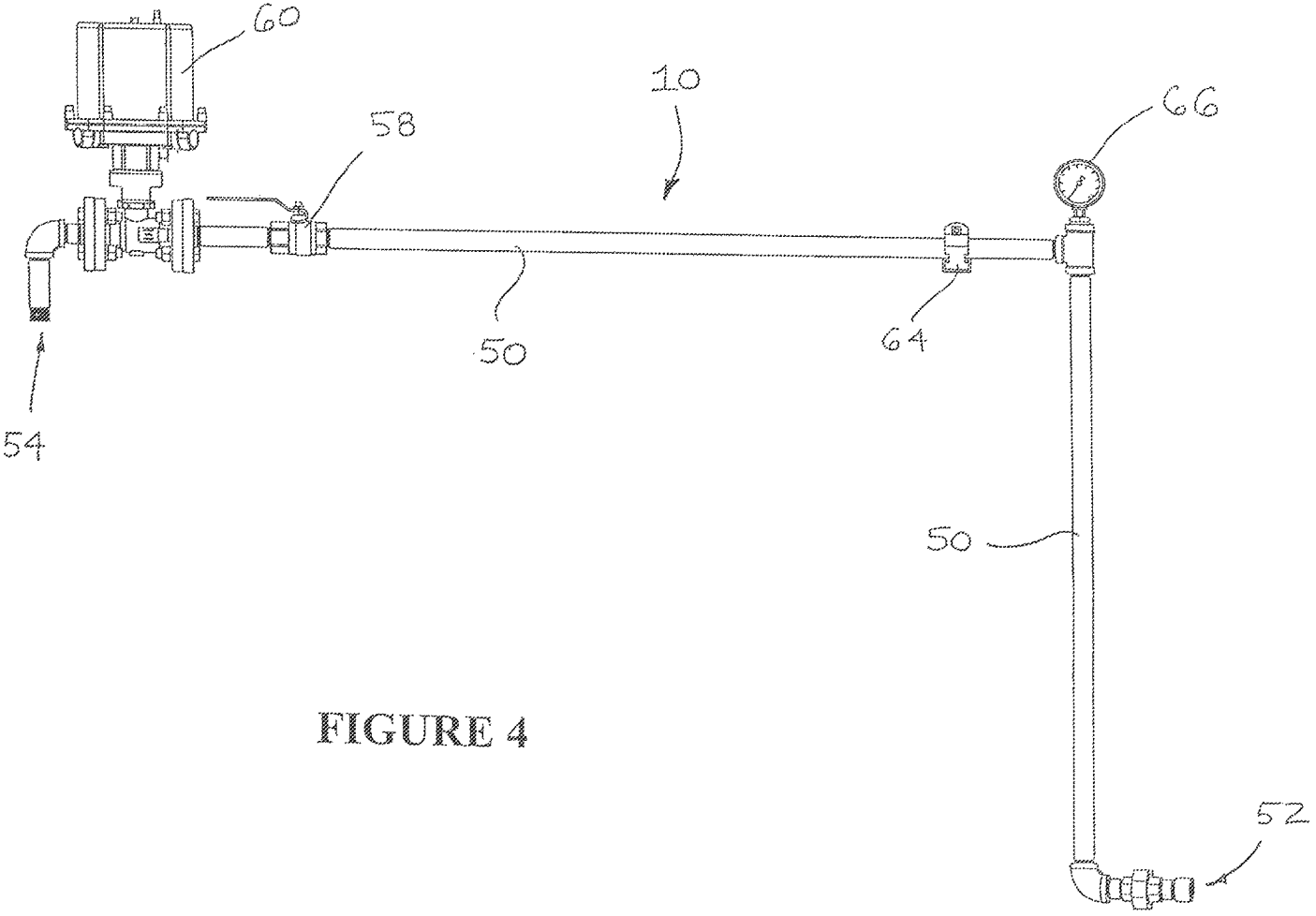
FIG. 4 is a front view of the preferred embodiment of the apparatus for producing a stabilizing base flame illustrated in FIG. 1.

Referring now to FIGS. 2 through 4, the preferred apparatus for producing a stabilizing base flame 10 may include one or more brackets 64 for securing the apparatus to a burner assembly and one or more gauges 66 adapted to measure any variety of physical conditions or characteristics of the apparatus such as the pressure or flow rate in the conduit.

Figure 5:
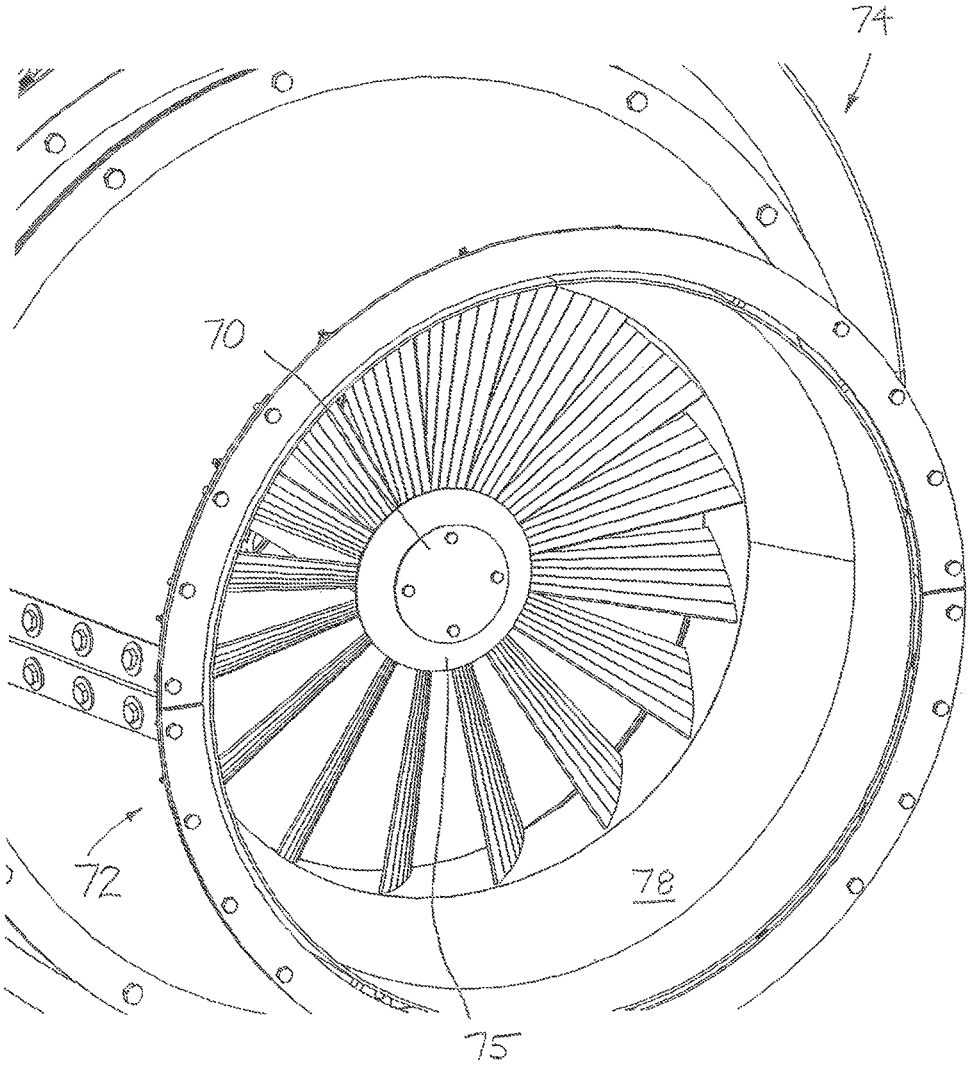
FIG. 5 is a perspective view of the preferred embodiment of the center fuel stabilization bluff body in accordance with the present invention.

Referring now to FIG. 5, a perspective view of the preferred embodiment of the center fuel stabilization bluff body in accordance with the present invention is illustrated. As shown in FIG. 5, the preferred center fuel stabilization bluff body is designated generally by reference numeral 70. The preferred center fuel stabilization bluff body 70 is a substantially circular disc mounted in burner end 72 of burner assembly 74. Preferably, center fuel stabilization bluff body 70 is mounted concentrically to ring 75 and liquid fuel nozzle 76 (see FIGS. 6 and 7). The preferred center fuel stabilization bluff body 70 is adapted to produce and maintain a strong, clean and stable base flame for main flame attachment. The preferred center fuel stabilization bluff body 70 causes fuel in the center of burner end 72 to disperse radially and symmetrically around the circumference of the disc. As a result, the preferred center fuel stabilization bluff body 70 enhances the mixing of the stabilizing base flame fuel with main combustion air so that the stabilizing base flame may be run throughout the entire firing range of the burner without adversely affecting the quality of the combustion emissions.

Still referring to FIG. 5, the preferred center fuel stabilization bluff body 70 also enhances the stabilizing characteristics of the premix stabilization base flame and enables the combustion of leaner premix gas mixtures. More particularly, the preferred center fuel stabilization bluff body 70 improves the stability of the base flame so that it may be run safely throughout the entire firing range of the burner, including higher main flame ranges with very lean mixtures. Further, the preferred center fuel stabilization bluff body 70 produces a symmetrical center base flame pattern that fills any vortices produced by the main flame and functions as a base for sustained main flame attachment. Still further, the preferred center fuel stabilization bluff body 70 also improves the shape of the main flame. More particularly, the preferred center fuel stabilization bluff body 70 tightens and shortens the main flame because flame attachment to the disc is continuous. As a result, damage to flame retention cone 78 is reduced. While FIG. 5 illustrates the preferred configuration and disposition of the center fuel stabilization bluff body, it is contemplated within the scope of the invention that the center fuel stabilization bluff body may be of any suitable configuration and disposition, including without limitation, a ring mounted concentrically to ring 75. It is also contemplated within the scope of the invention that more than one center fuel stabilization bluff body may be provided.

Figure 6:
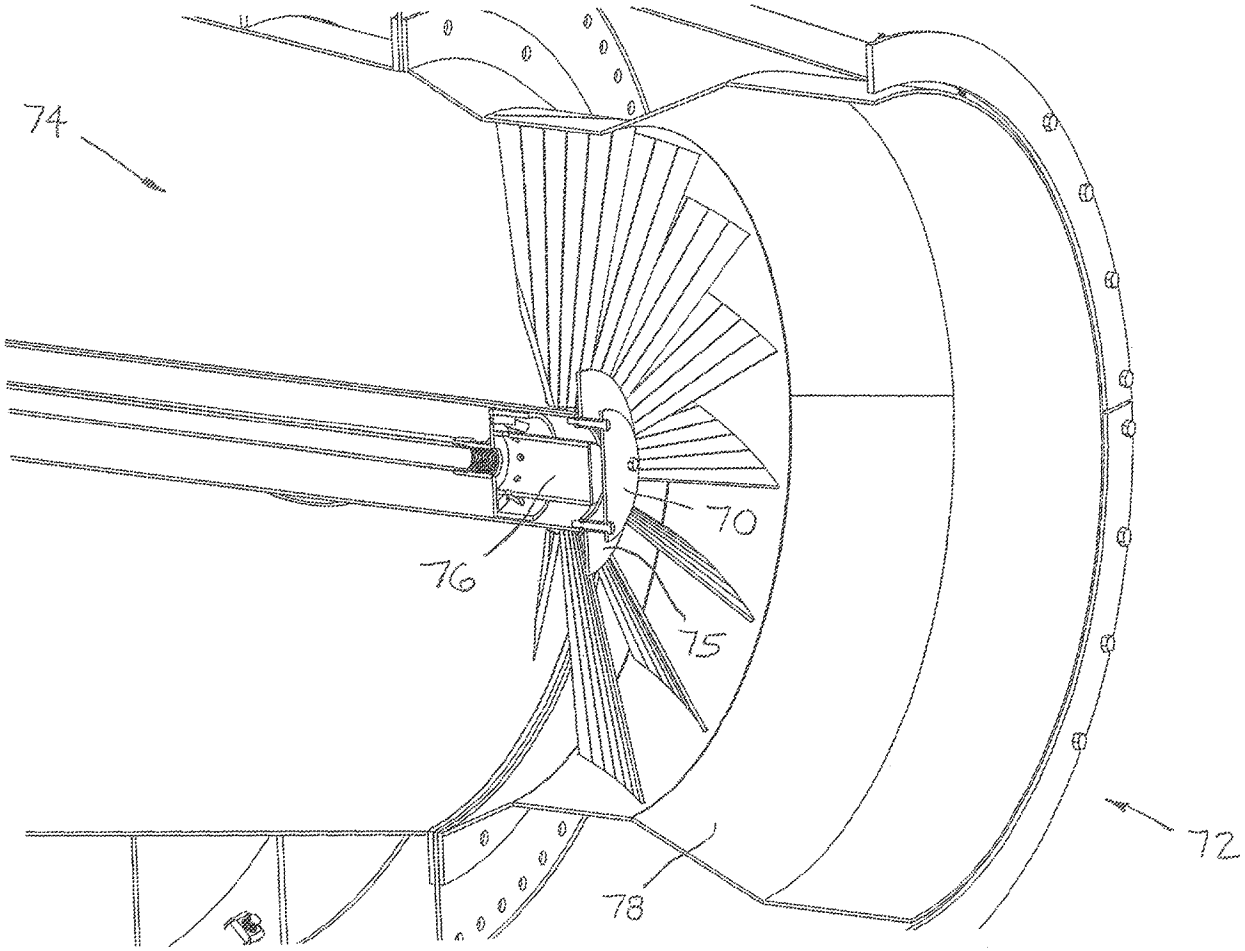
FIG. 6 is a sectional perspective view of the preferred center fuel stabilization bluff body illustrated in FIG. 5.
Figure 7:
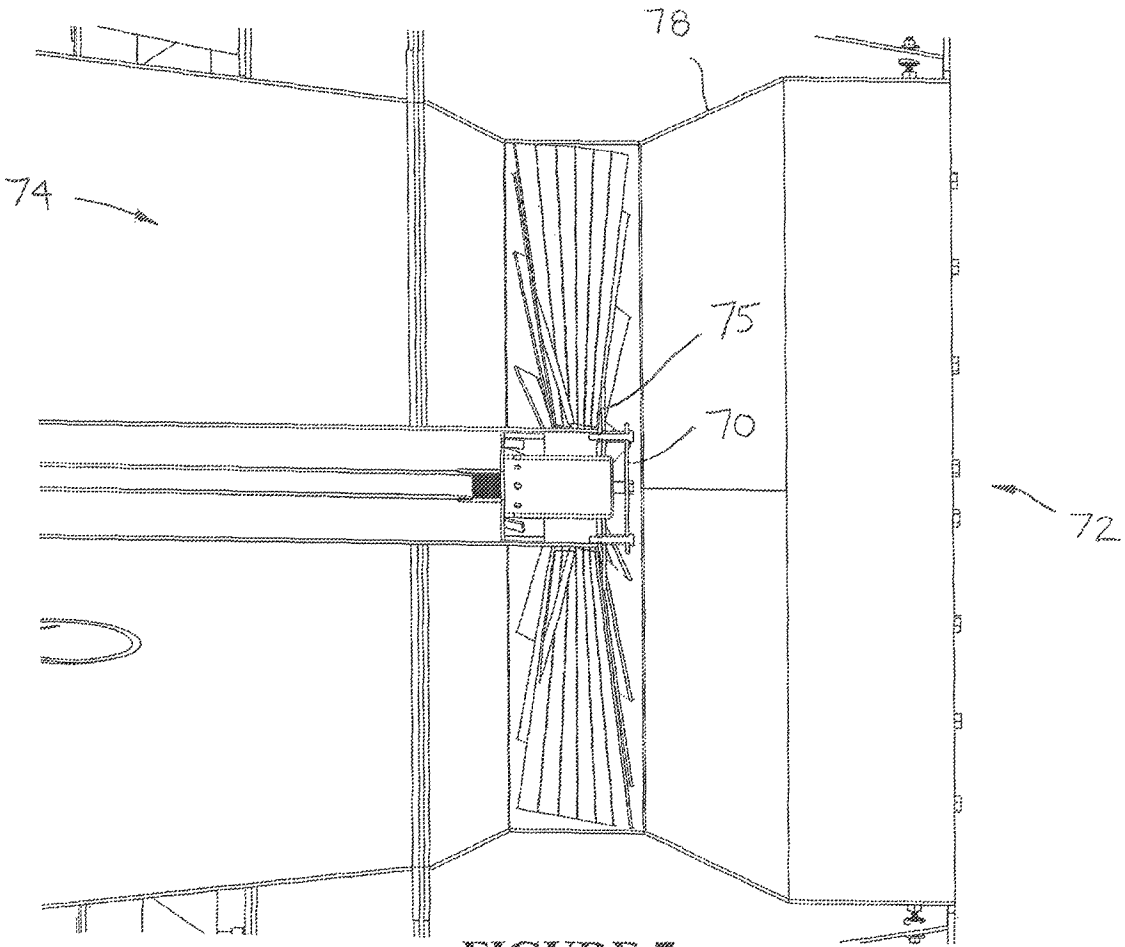
FIG. 7 is a sectional front view of the preferred center fuel stabilization bluff body illustrated in FIGS. 5 and 6.
Figure 8:
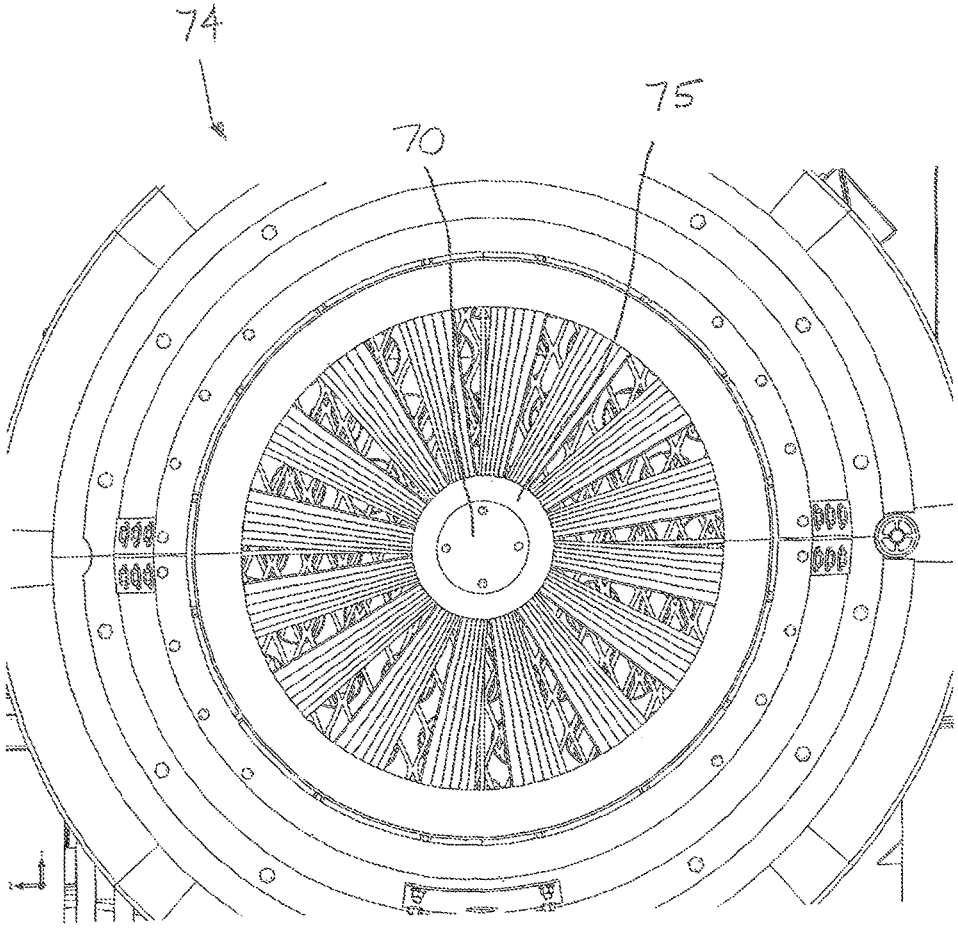
FIG. 8 is a right side view of the preferred center fuel stabilization bluff body illustrated in FIGS. 5 through 7.

Referring now to FIG. 6, a sectional perspective view of preferred center fuel stabilization bluff body 70 is illustrated. As shown in FIG. 6, the preferred center fuel stabilization bluff body 70 is mounted in burner end 72 of burner assembly 74 such that it is substantially concentrically aligned with ring 75 and liquid fuel nozzle 76. As a result, the preferred center fuel stabilization bluff body 70 causes fuel in the center of burner end 72 to disperse radially and symmetrically around the circumference of the disc, thereby enhancing the mixing of the stabilizing base flame fuel with the main combustion air. See also FIGS. 7 and 8.

Figure 9:
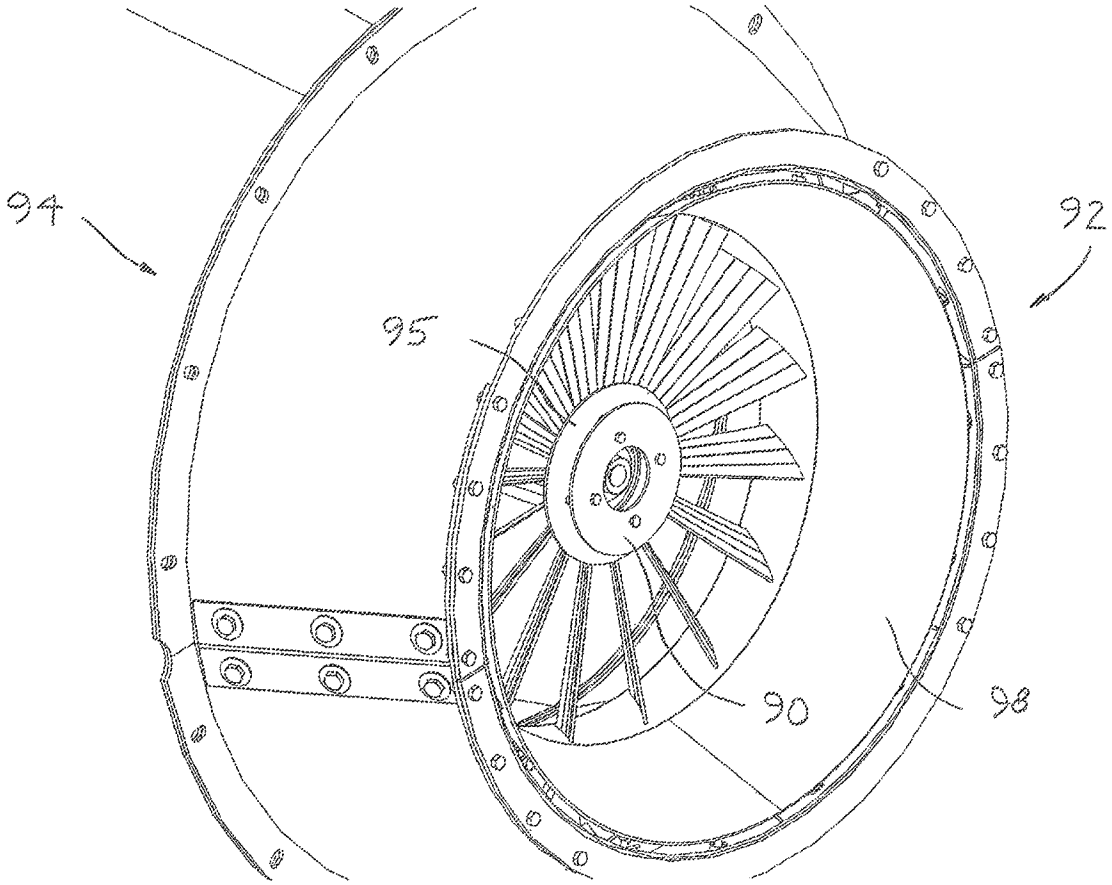
FIG. 9 is a perspective view of a first alternative embodiment of the center fuel stabilization bluff body in accordance with the present invention.

Referring now to FIG. 9, a perspective view of a first alternative embodiment of the center fuel stabilization bluff body is illustrated. As shown in FIG. 9, the first alternative embodiment of the center fuel stabilization bluff body is designated generally by reference numeral 90. The preferred center fuel stabilization bluff body 90 is generally shaped like a ring and is mounted in burner end 92 of burner assembly 94. Preferably, center fuel stabilization bluff body 90 is mounted concentrically to ring 95 and liquid fuel nozzle 96 (see FIGS. 10 and 11). The preferred center fuel stabilization bluff body 90 is adapted to produce and maintain a strong, clean and stable base flame for main flame attachment. The preferred center fuel stabilization bluff body 90 causes fuel in the center of burner end 92 to disperse radially and symmetrically around the circumference of the ring. As a result, the preferred center fuel stabilization bluff body 90 enhances the mixing of the stabilizing base flame fuel with main combustion air so that the stabilizing base flame may be run throughout the entire firing range of the burner without adversely affecting the quality of the combustion emissions.

Still referring to FIG. 9, the preferred center fuel stabilization bluff body 90 also enhances the stabilizing characteristics of the premix stabilization base flame and enables the combustion of leaner premix gas mixtures. More particularly, the preferred center fuel stabilization bluff body 90 improves the stability of the base flame so that it may be run safely throughout the entire firing range of the burner, including higher main flame ranges with very lean mixtures. Further, the preferred center fuel stabilization bluff body 90 produces a symmetrical center base flame pattern that fills any vortices produced by the main flame and functions as a base for sustained main flame attachment. Still further, the preferred center fuel stabilization bluff body 90 also improves the shape of the main flame. More particularly, the preferred center fuel stabilization bluff body 90 tightens and shortens the main flame because flame attachment to the ring is continuous. As a result, damage to flame retention cone 98 is reduced. While FIG. 9 illustrates the preferred configuration and disposition of the center fuel stabilization bluff body, it is contemplated within the scope of the invention that the center fuel stabilization bluff body may be of any suitable configuration and disposition. It is also contemplated within the scope of the invention that more than one center fuel stabilization bluff body may be provided.

Figure 10:
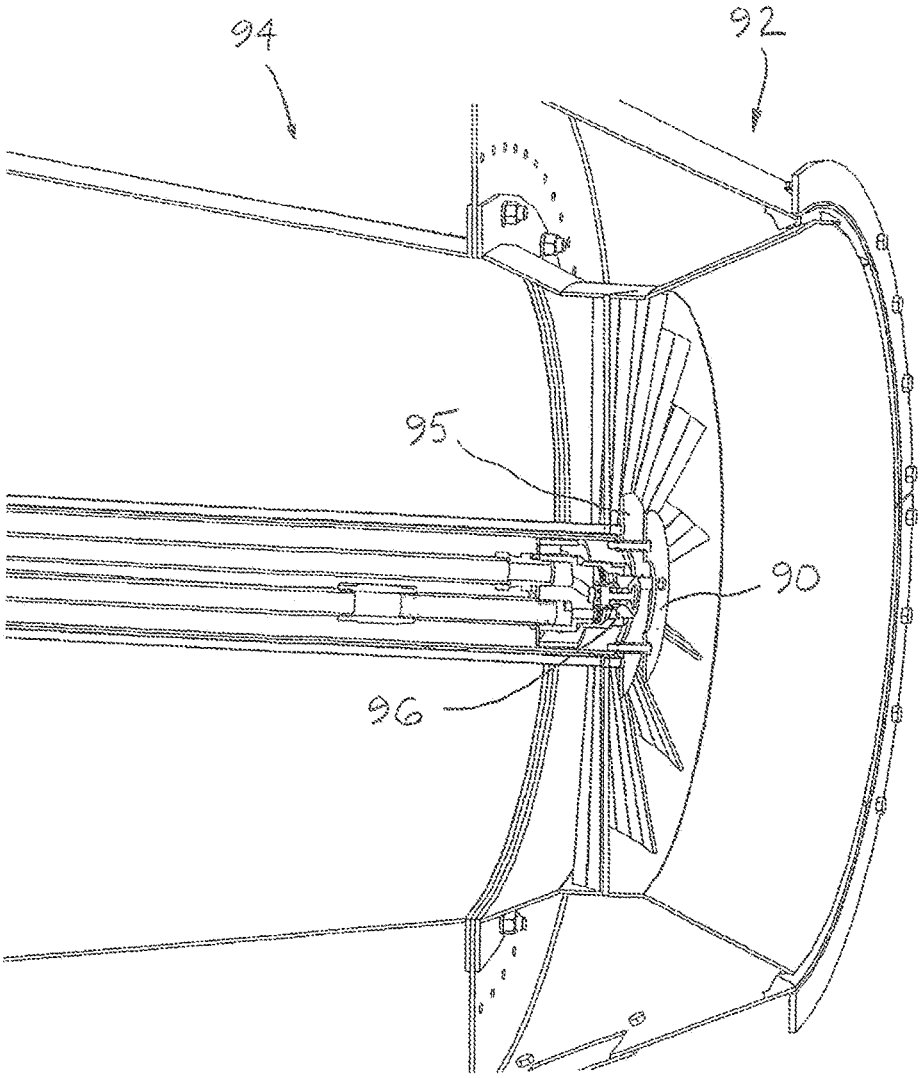
FIG. 10 is a sectional perspective view of the first alternative embodiment of the center fuel stabilization bluff body illustrated in FIG. 9.
Figure 11:
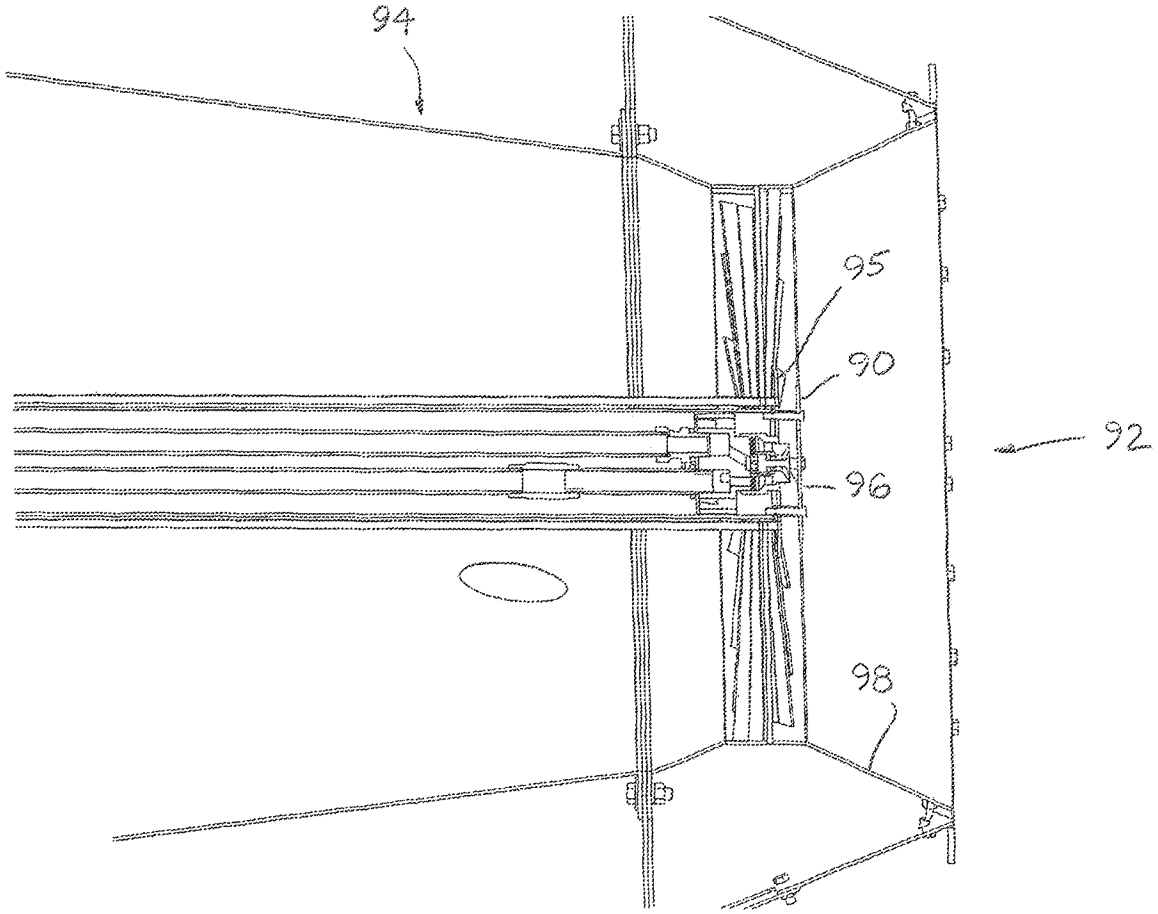
FIG. 11 is a sectional front view of the first alternative embodiment of the center fuel stabilization bluff body illustrated in FIGS. 9 and 10.
Figure 12:
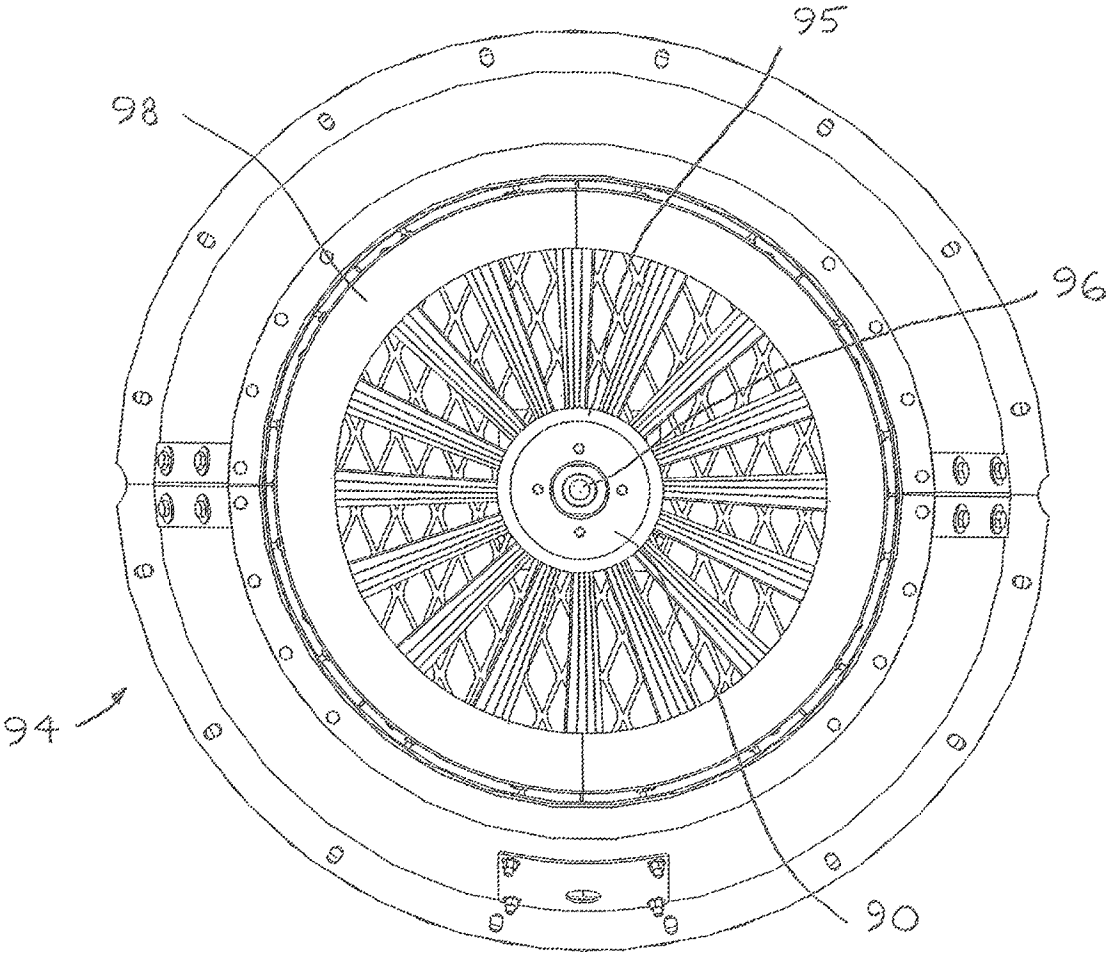
FIG. 12 is a right side view of the first alternative embodiment of the center fuel stabilization bluff body illustrated in FIGS. 9 through 11.

Referring now to FIG. 10, a sectional perspective view of preferred center fuel stabilization bluff body 90 is illustrated. As shown in FIG. 10, the preferred center fuel stabilization bluff body 90 is mounted in burner end 92 of burner assembly 94 such that it is substantially concentrically aligned with ring 95 and liquid fuel nozzle 96. As a result, the preferred center fuel stabilization bluff body 90 causes fuel in the center of burner end 92 to disperse radially and symmetrically around the circumference of the ring, thereby enhancing the mixing of the stabilizing base flame fuel with the main combustion air. See also FIGS. 11 and 12.

Figure 13:
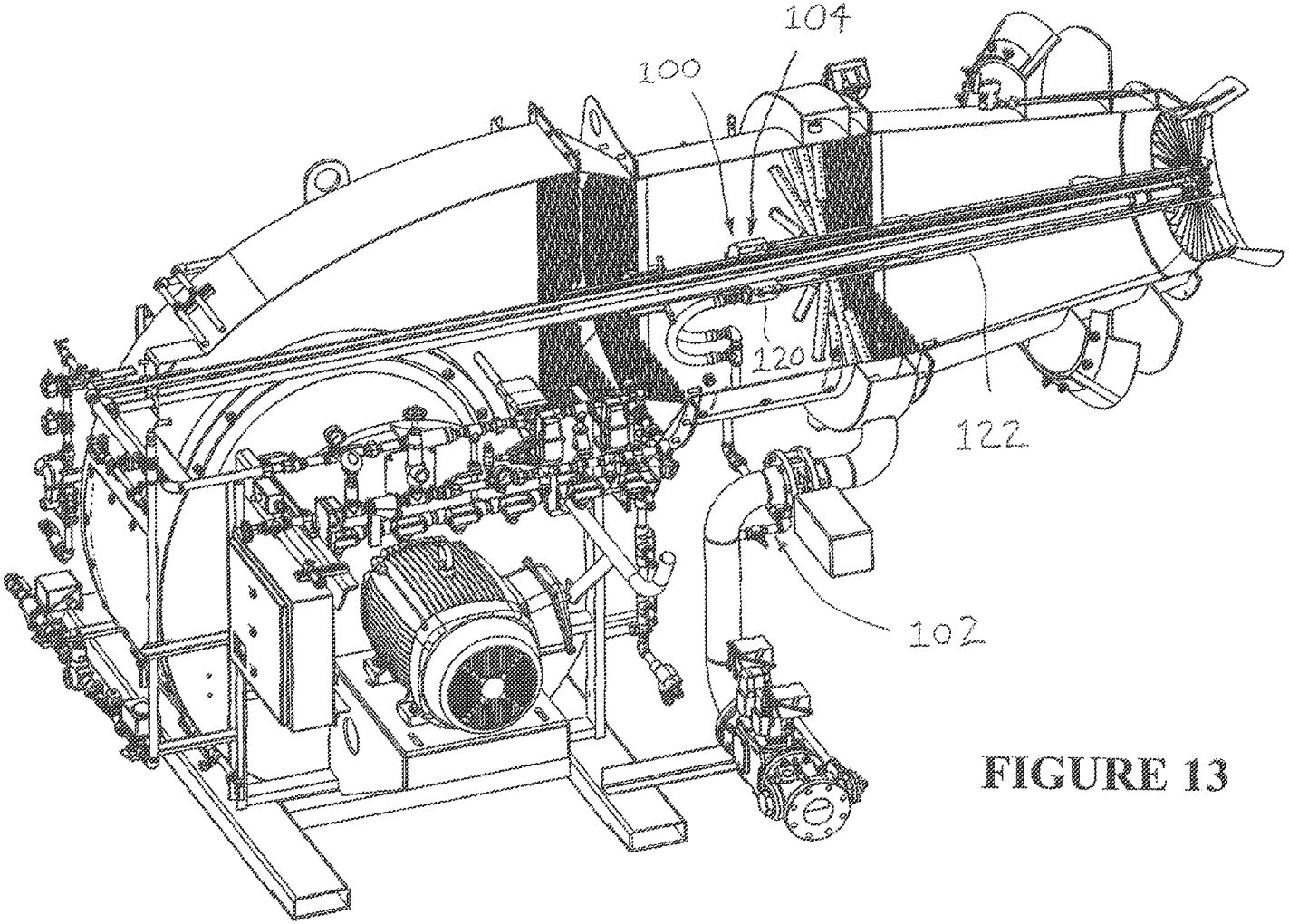
FIG. 13 is a partial sectional perspective view of a first alternative embodiment of the apparatus for producing a stabilizing base flame assembled to an exemplary burner assembly.

Referring now to FIG. 13, a partial sectional perspective view of a first alternative embodiment of the apparatus for producing a stabilizing base flame assembled to an exemplary burner assembly is illustrated. As shown in FIG. 13, the preferred apparatus for producing a stabilizing base flame is designated generally by reference numeral 100. The preferred apparatus for producing a stabilizing base flame 100 comprises conduit assembly 102 (see also FIG. 14) and manifold assembly 104 (see also FIGS. 15 and 16). The preferred apparatus for producing a stabilizing base flame 100 is adapted to convey gaseous fuel only. As a result, the preferred apparatus for producing a stabilizing base flame 100 does not require a purge. It is contemplated within the scope of the invention that the apparatus for producing a stabilizing base flame may also be adapted to convey liquid fuel or a combination of gaseous and liquid fuel.

Figure 14:
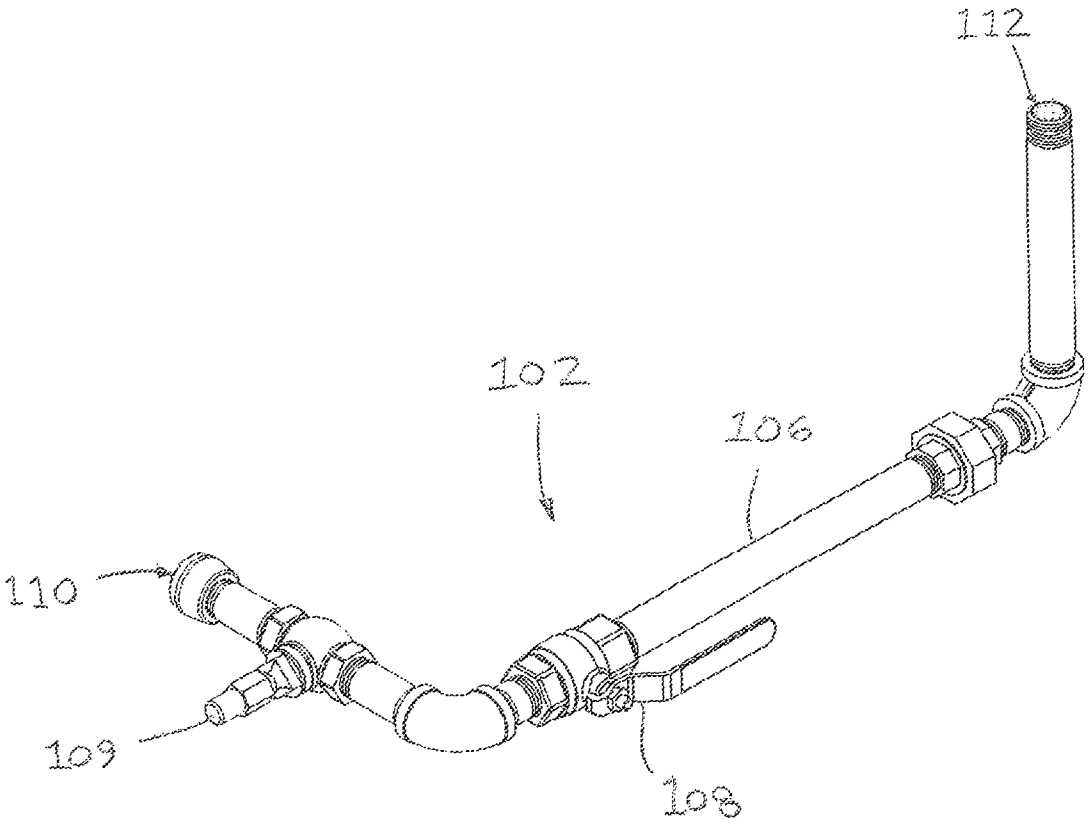
FIG. 14 is a perspective view of the conduit assembly of the alternative embodiment of the apparatus for producing a stabilizing base flame illustrated in FIG. 13.

Referring now to FIG. 14, a perspective view of preferred conduit assembly 102 of apparatus for producing a stabilizing base flame 100 is illustrated. As shown in FIG. 14, preferred conduit assembly 102 comprises conduit 106, manual ball valve 108, adjustable limiting orifice 109, gaseous fuel line inlet end 110 and gaseous fuel line outlet end 112.

Figure 15:
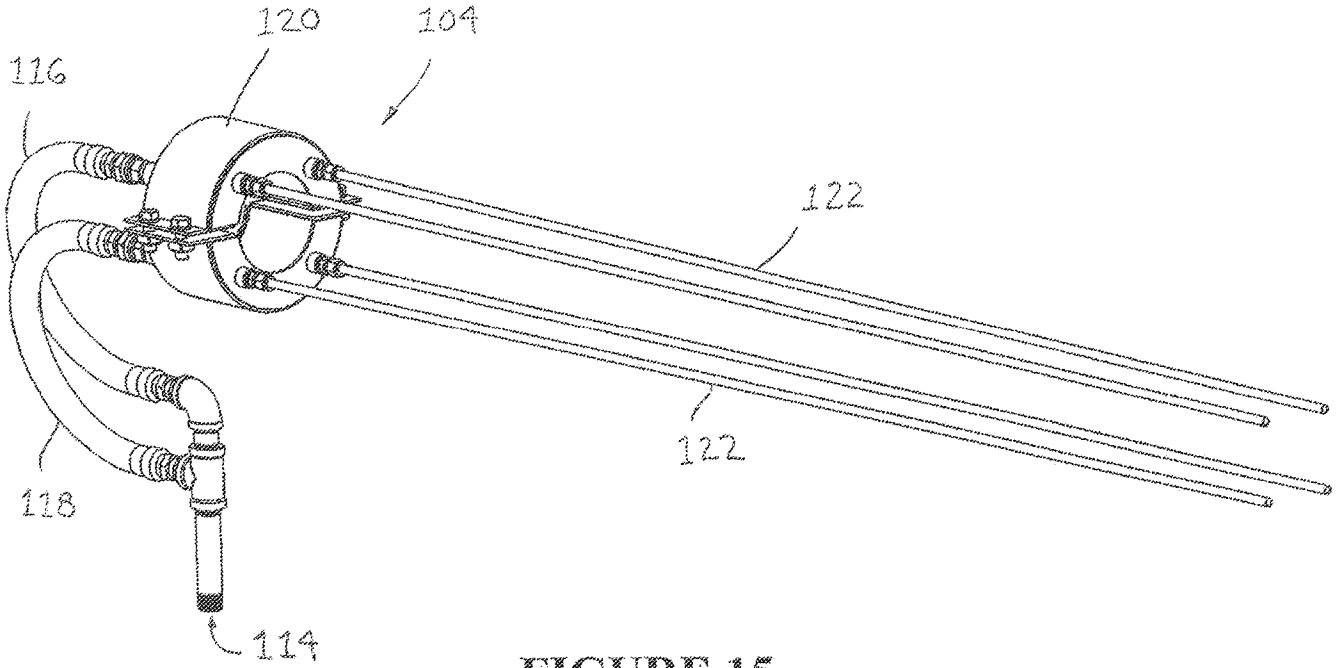
FIG. 15 is a perspective view of the manifold assembly of the alternative embodiment of the apparatus for producing a stabilizing base flame illustrated in FIGS. 13-14.
Figure 16:
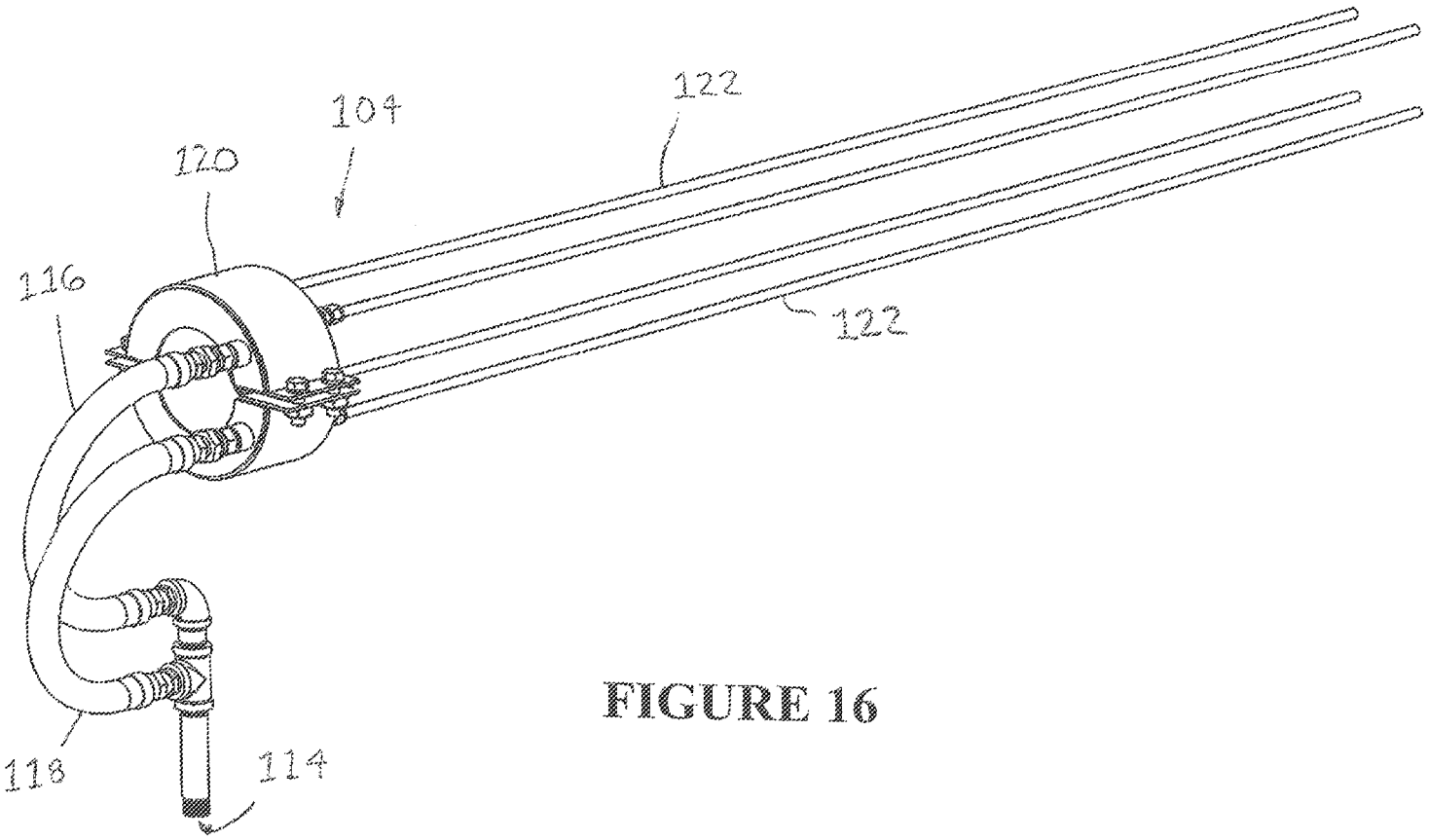
FIG. 16 is a perspective view of the manifold assembly of the alternative embodiment of the apparatus for producing a stabilizing base flame illustrated in FIGS. 13-15.

Referring now to FIGS. 15 and 16, perspective views of preferred manifold assembly 104 of apparatus for producing a stabilizing base flame 100 are illustrated. As shown in FIGS. 15 and 16, preferred manifold assembly 104 comprises gaseous fuel line inlet end 114, conduits 116 and 118, manifold 120 and outlet pipes 122. As shown in FIG. 13, preferred manifold 120 surrounds the liquid fuel line that extends along the longitudinal axis of the burner assembly. Also shown in FIG. 13, preferred outlet pipes 122 extend along the liquid fuel line to the burner end of the assembly.

Figure 17:
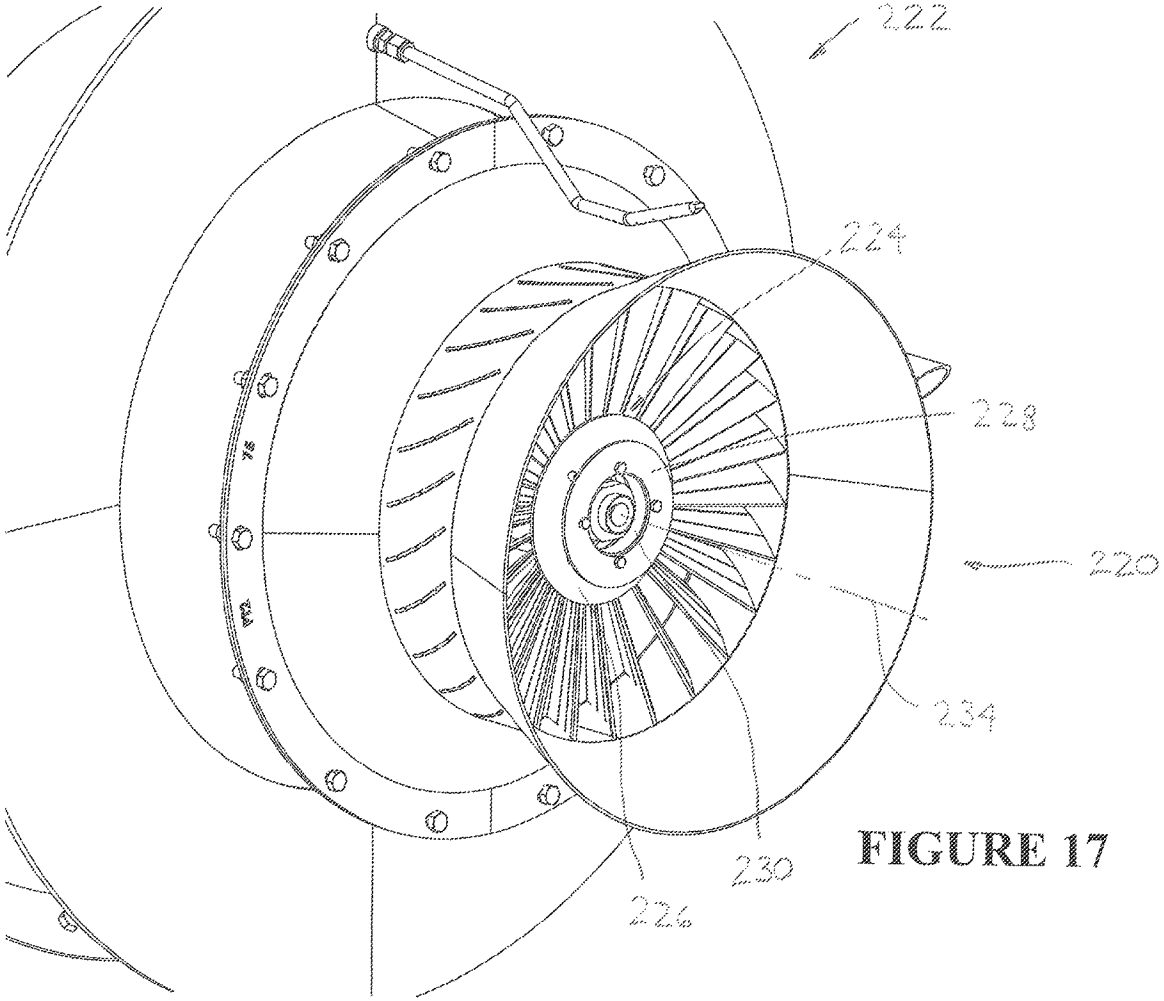
FIG. 17 is a perspective view of an exemplary burner end of a burner assembly including an alternative preferred embodiment of the bluff body in accordance with the present invention.

Referring now to FIG. 17, a perspective view of exemplary burner end 220 of burner assembly 222 including an alternative preferred embodiment of bluff body 224 is illustrated. As shown in FIG. 17, preferred bluff body 224 comprises first ring 226, second ring 228 and cylinder 230 disposed between the first ring and the second ring. Preferably, cylinder 230 is solid and disposed on each of the inner diameters of first ring 226 and second ring 228. Preferred cylinder 230 is adapted to prevent gaseous fuel conveyed by gaseous fuel lines 232 from being entrained in air flows along center axis 234 of burner assembly 222. Instead, preferred cylinder 230 together with second ring 228 cause gaseous fuel conveyed by gaseous fuel lines 232 (see FIGS. 24-26) to flow radially or outwardly away from center axis 234. By preventing gaseous fuel conveyed by the gaseous fuel lines from being entrained in air flows along the center axis of the burner assembly and instead conveying it radially, several advantages are achieved by preferred bluff body 224. For example, preferred bluff body 224 minimizes or eliminates undesirable emissions produced by a burner assembly. Preferred bluff body 224 also produces a symmetrical flame pattern that is stable throughout all firing ranges. Preferred bluff body 224 further provides improved light off reliability. Preferred bluff body 224 still further conveys gas flow radially and minimizes or eliminates undesirable axial gas flow. While FIG. 1 illustrates the preferred configuration and arrangement of the bluff body, it is contemplated within the scope of the invention that the bluff body may be of any suitable configuration and arrangement.

Figure 18:
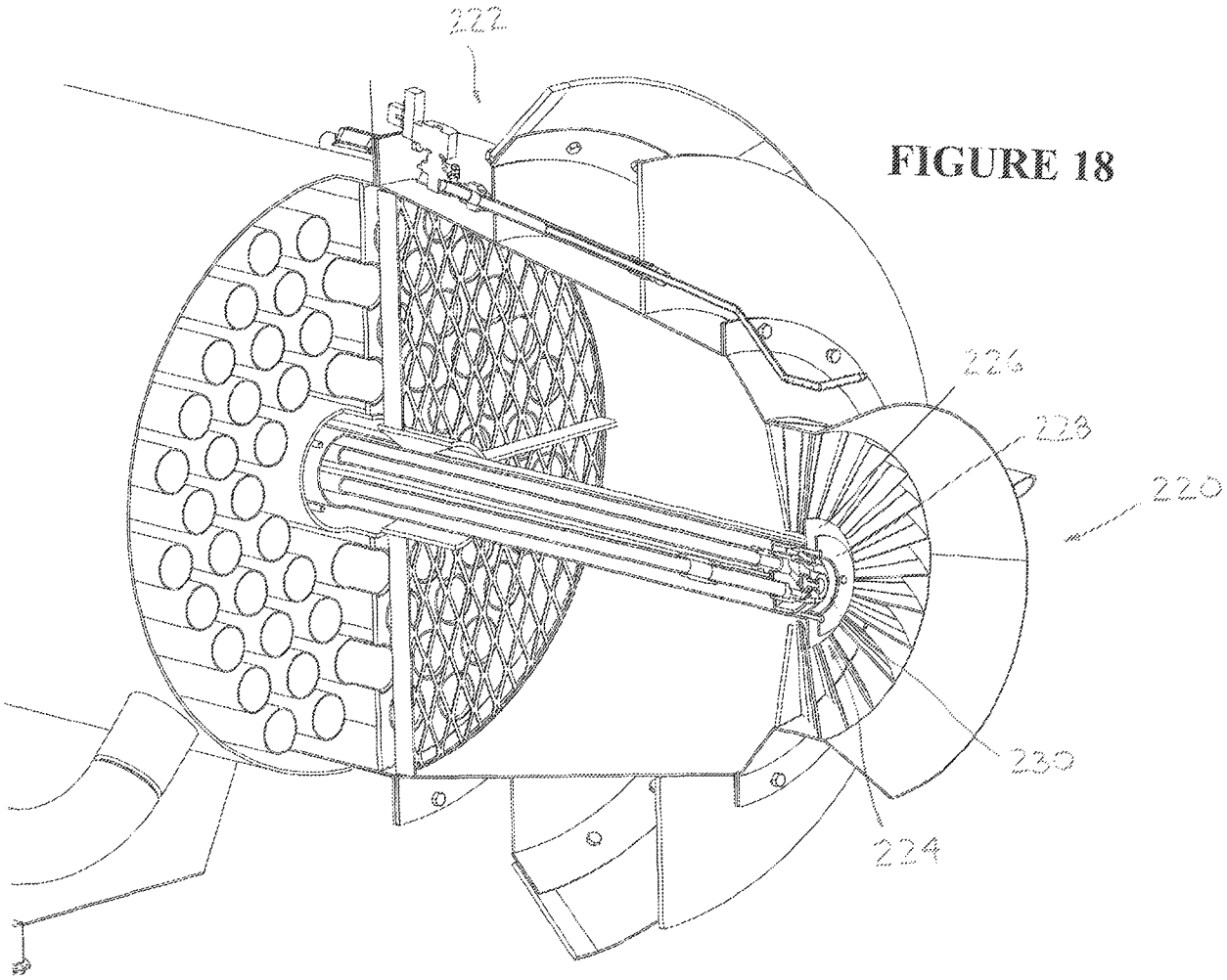
FIG. 18 is a partial sectional perspective view of the exemplary burner end of the burner assembly including the preferred bluff body illustrated in FIG. 17.

Referring now to FIG. 18, a partial sectional perspective view of burner end 220 of burner assembly 222 including the preferred bluff body 224 is illustrated. As shown in FIG. 18, preferred bluff body 224 comprises first ring 226, second ring 228 and cylinder 230.

Figure 19:
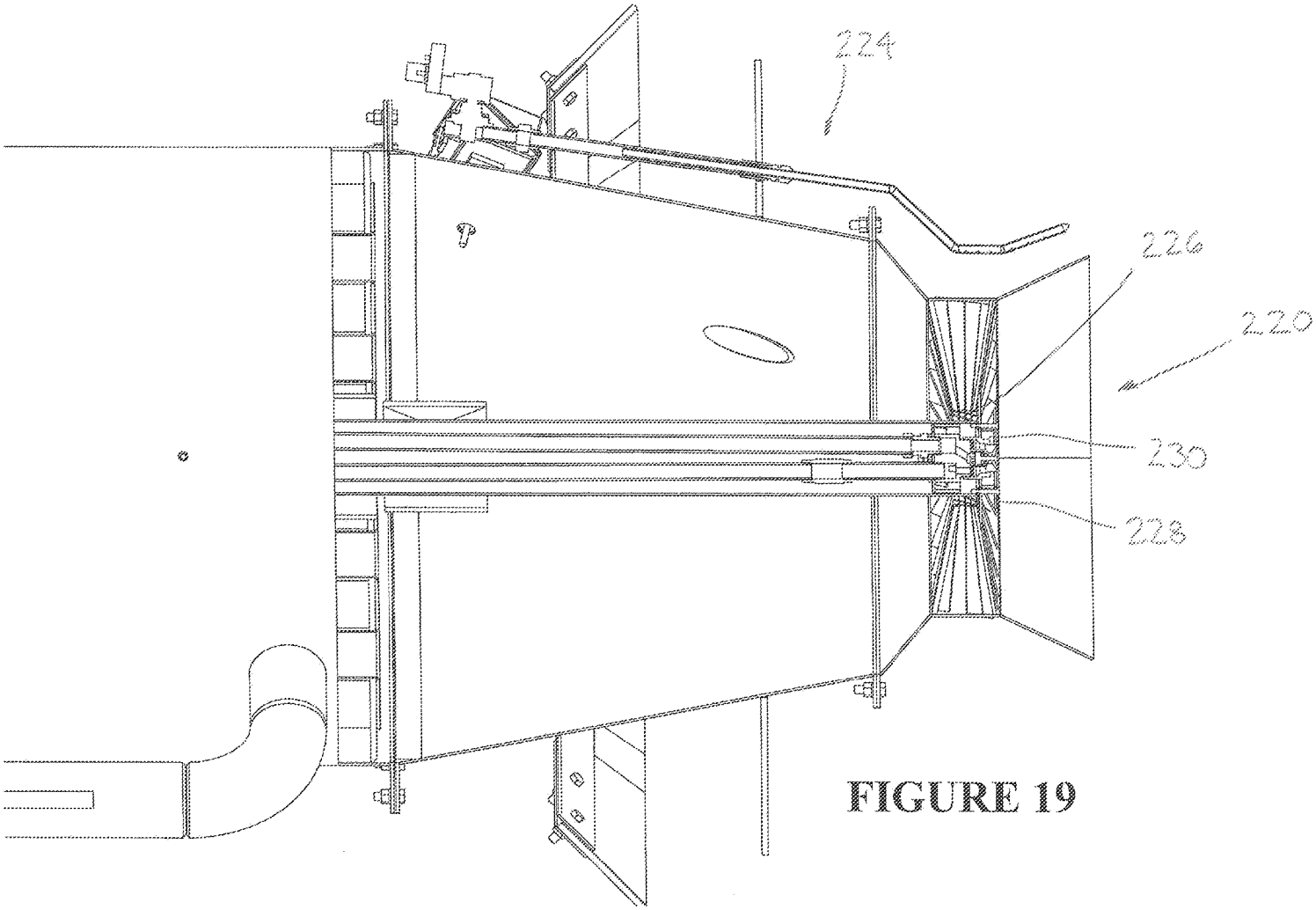
FIG. 19 is a partial section front view of the exemplary burner end of the burner assembly including the preferred bluff body illustrated in FIGS. 17 and 18.

Referring now to FIG. 19, a partial section front view of exemplary burner end 220 of burner assembly 222 including preferred bluff body 224 is illustrated. As shown in FIG. 19, preferred bluff body 224 comprises first ring 226, second ring 228 and cylinder 230.

Figure 20:
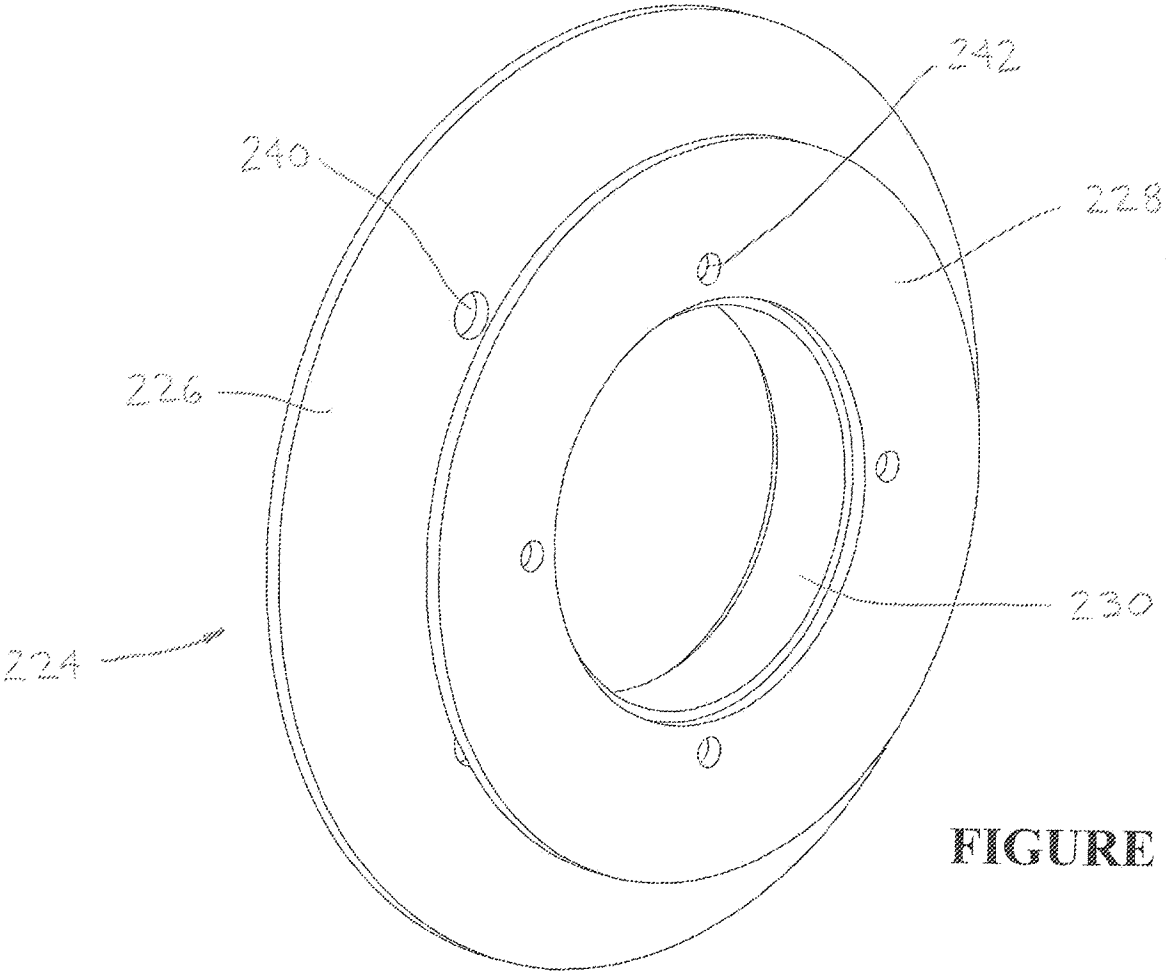
FIG. 20 is a perspective view of the preferred bluff body illustrated in FIGS. 17 through 19.

Referring now to FIG. 20, a perspective view of preferred bluff body 224 is illustrated. As shown in FIG. 20, preferred bluff body 224 comprises first ring 226, second ring 228 and cylinder 230. Preferred first ring 226 comprises gaseous fuel line holes 240 and preferred second ring 228 comprises second ring bolt holes 242. While FIG. 20 illustrates the preferred configuration and arrangement of the gaseous fuel line holes and the second ring bolt holes, it is contemplated within the scope of the invention that the gaseous fuel line holes and the second ring bolt holes may be of any suitable configuration and arrangement. It is also contemplated within the scope of the invention that more or fewer than four (4) gaseous fuel line holes and more or fewer than four (4) second ring bolt holes may be provided.

Figure 21:
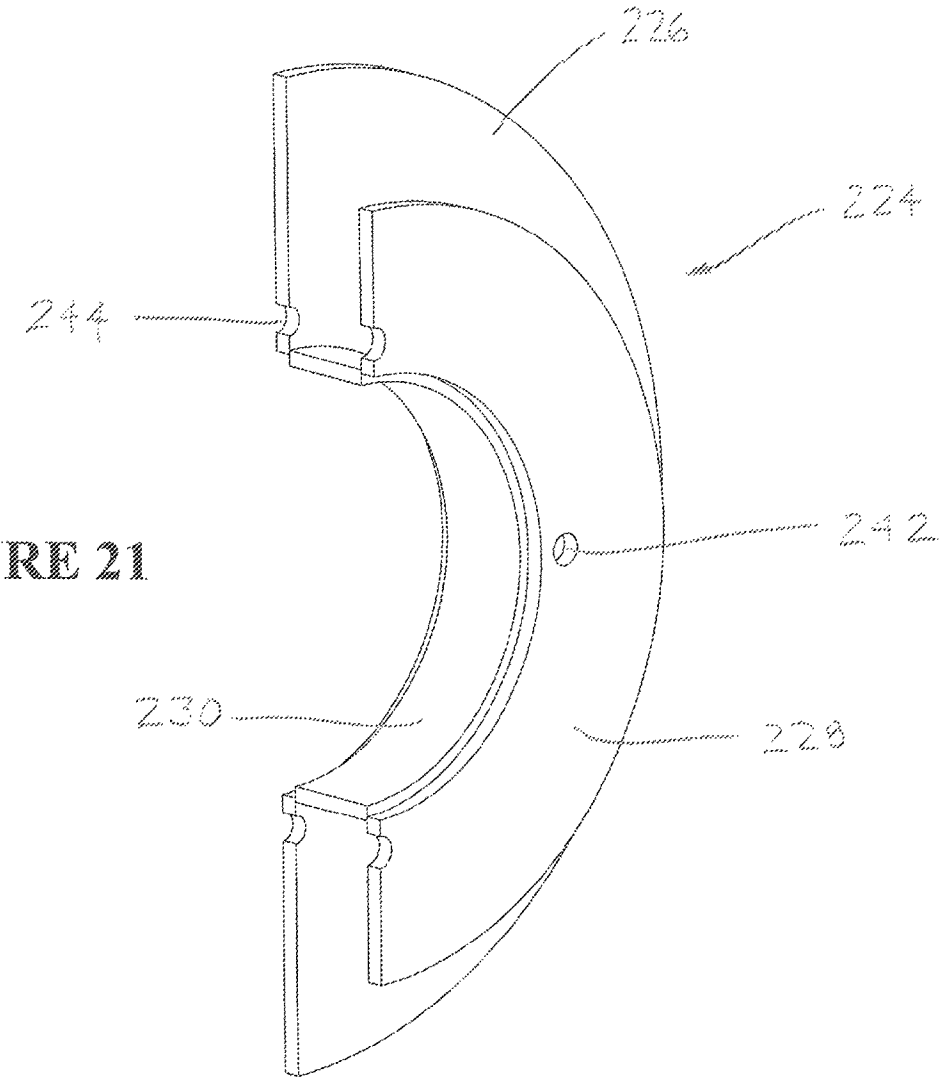
FIG. 21 is a partial sectional perspective view of the preferred bluff body illustrated in FIGS. 17 through 20.

Referring now to FIG. 21, a partial sectional perspective view of the preferred bluff body is illustrated. As shown in FIG. 21, preferred bluff body 224 comprises first ring 226, second ring 228, and cylinder 230. Preferred first ring 226 comprises first ring bolt holes 244 and preferred second ring 228 comprises second ring bolt holes 242. While FIG. 21 illustrates the preferred configuration and arrangement of the first ring bolt holes, it is contemplated within the scope of the invention that the first ring bolt holes may be of any suitable configuration and arrangement. It is also contemplated within the scope of the invention that more or fewer than four (4) first ring bolt holes may be provided.

Figure 22:
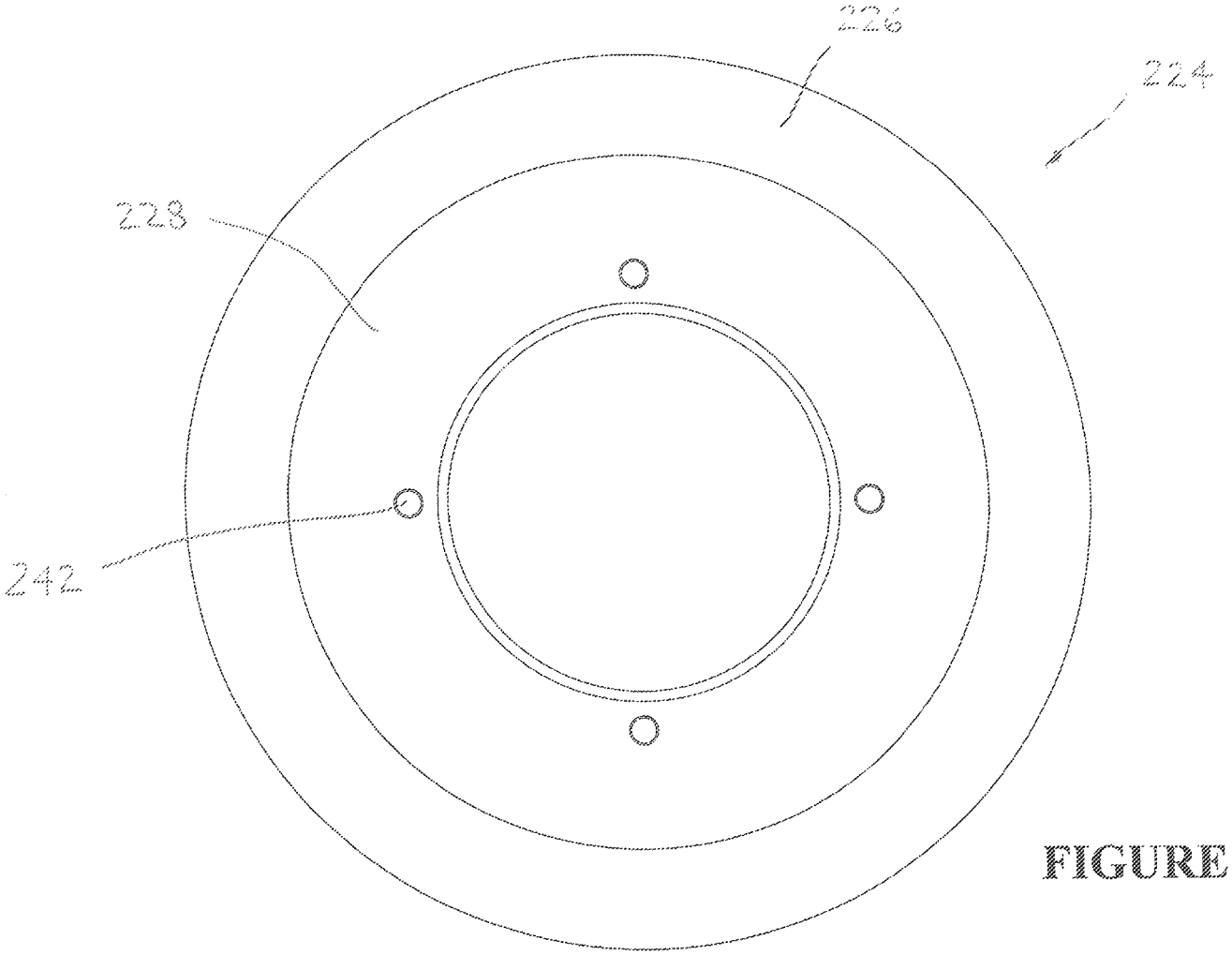
FIG. 22 is a front view of the preferred bluff body illustrated in FIGS. 17 through 21.

Referring now to FIG. 22, a front view of preferred bluff body 224 is illustrated. As shown in FIG. 22, preferred bluff body 224 comprises first ring 226, second ring 228, cylinder 230 and second ring bolt holes 242.

Figure 23:
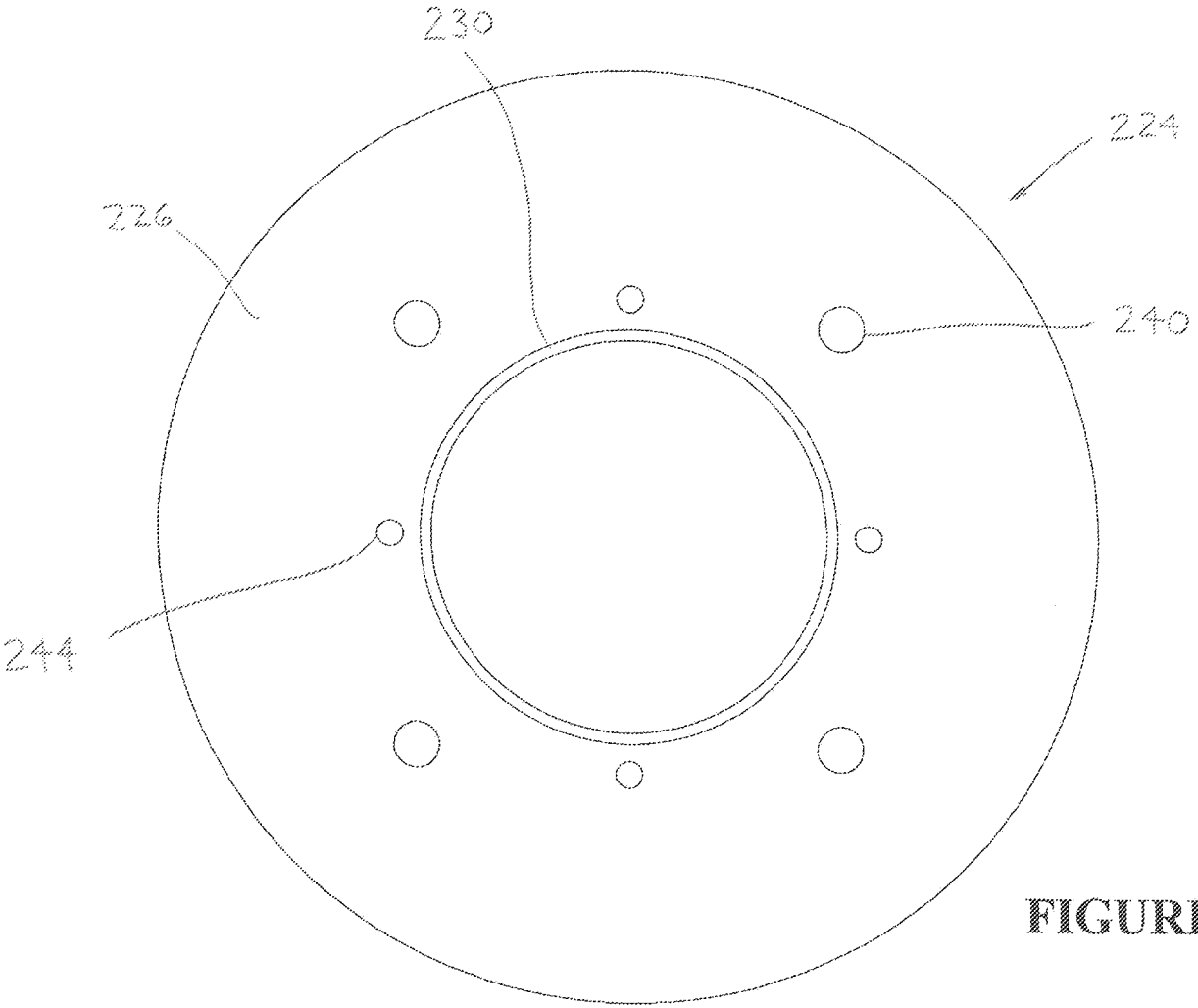
FIG. 23 is a rear view of the preferred bluff body illustrated in FIGS. 17 through 22.

Referring now to FIG. 23, a rear view of preferred bluff body 224 is illustrated. As shown in FIG. 23, preferred bluff body 224 comprises first ring 226, cylinder 230, gaseous fuel line holes 240 and first ring bolt holes 244.

Figure 24:
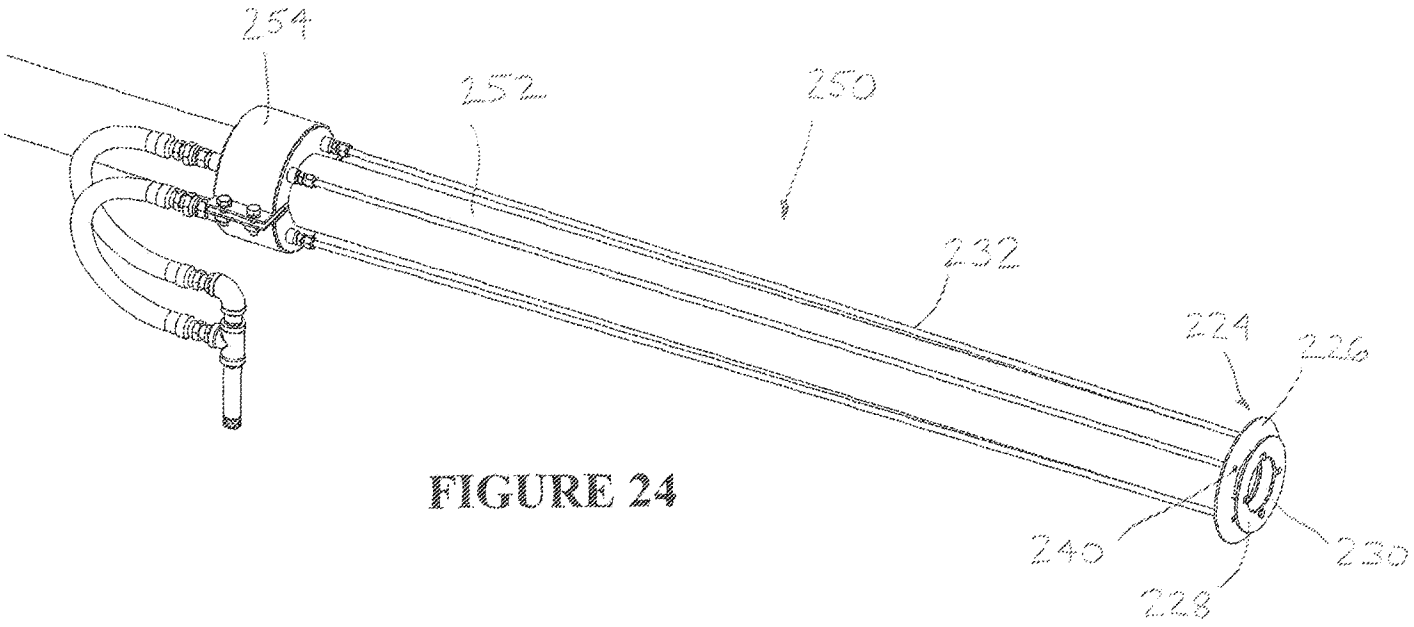
FIG. 24 is a perspective view of an exemplary center fuel stabilization assembly including the preferred bluff body illustrated in FIGS. 17 through 23.

Referring now to FIG. 24, a perspective view of exemplary center fuel stabilization assembly 250 including preferred bluff body 224 is illustrated. As shown in FIG. 24, preferred bluff body 224 comprises first ring 226, second ring 228, cylinder 230 and gaseous fuel line holes 240. Preferred center fuel stabilization assembly 250 also comprises gaseous fuel lines 232, center axis tube 252 and gaseous fuel line manifold 254. While FIG. 24 illustrates the preferred configuration and arrangement of the center fuel stabilization assembly, it is contemplated within the scope of the invention that the center fuel stabilization assembly may be of any suitable configuration and arrangement. It is also contemplated within the scope of the invention that more or few than four (4) gaseous fuel lines may be provided.

Figure 25:
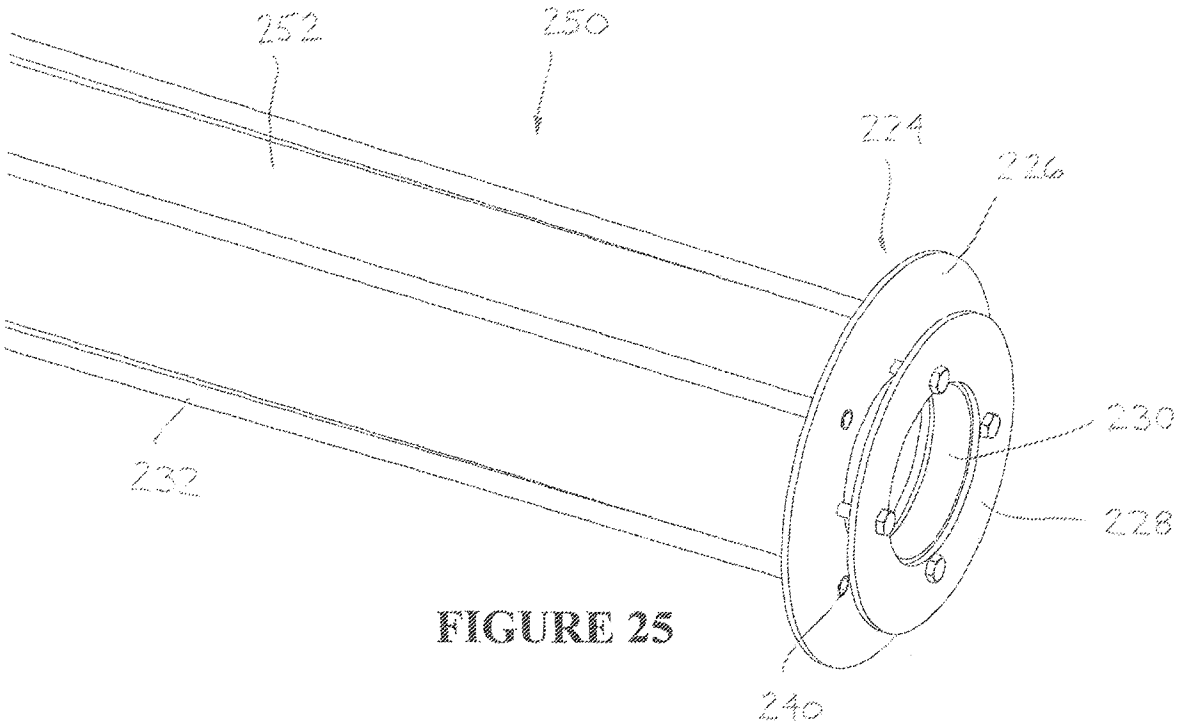
FIG. 25 is a perspective view of the burner end of the exemplary center fuel stabilization assembly including the preferred bluff body illustrated in FIGS. 17 through 24.

Referring now to FIG. 25, a perspective view of the burner end of center fuel stabilization assembly 250 including preferred bluff body 224 is illustrated. As shown in FIG. 25, preferred bluff body 224 comprises first ring 226, second ring 228, cylinder 230 and first ring gaseous fuel holes 240. Preferred center fuel stabilization assembly 250 also comprises gaseous fuel lines 232 and center axis tube 252.

Figure 26:
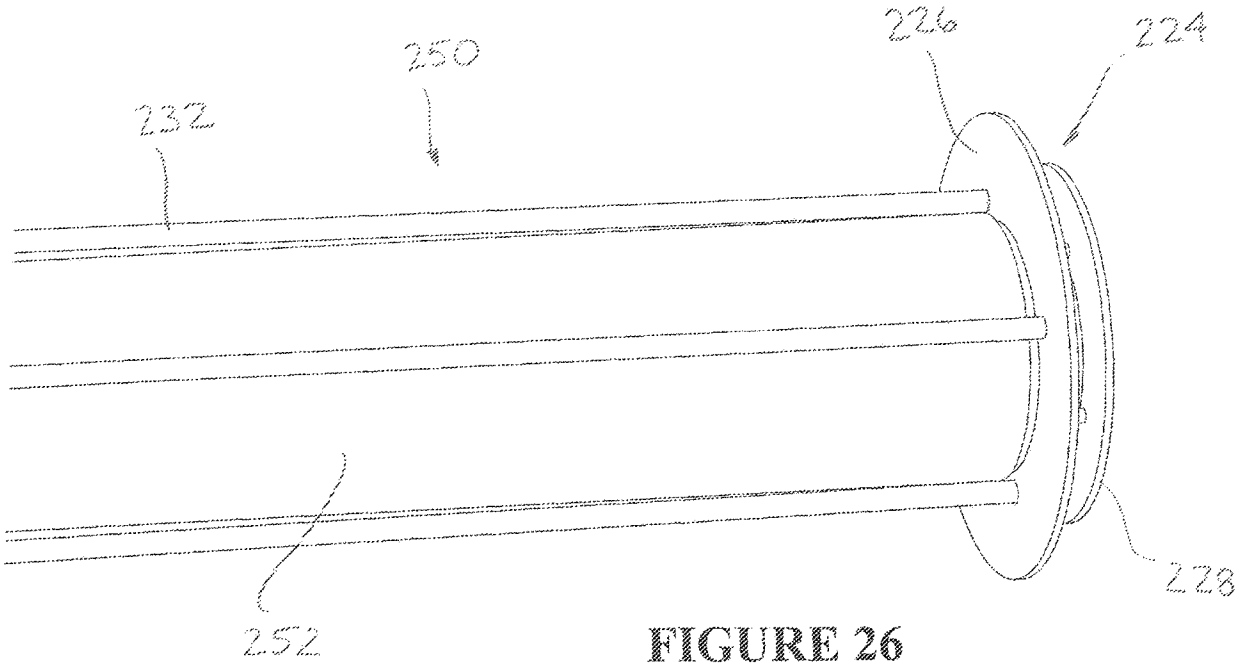
FIG. 26 is a perspective view of the burner end of the exemplary center fuel stabilization assembly including the preferred bluff body illustrated in FIGS. 17 through 25.

Referring now to FIG. 26, a perspective view of the burner end of center fuel stabilization assembly 250 including preferred bluff body 224 is illustrated. As shown in FIG. 26, preferred bluff body 224 comprises first ring 226 and second ring 228. Preferred center fuel stabilization assembly 250 comprises gaseous fuel lines 232 and center axis tube 252.

According to the method of the invention, a stabilizing base flame for a premix main burner flame is produced in a burner assembly having a burner end, a first fuel line (preferably a gaseous fuel line for conveying gaseous fuel), a first fuel nozzle in fluid communication with the first fuel line, a second fuel line (preferably a liquid fuel line for conveying liquid fuel), and a second fuel nozzle in fluid communication with the second fuel line. The preferred method comprises the step of providing an apparatus for producing a stabilizing base flame. The preferred apparatus comprises a conduit in fluid communication with the first fuel line (preferably a gaseous fuel line) and the second fuel line (preferably a liquid fuel line), a valve (preferably a manual valve, an automatic valve, or any combination thereof) in fluid communication with the conduit and a center fuel stabilization bluff body mounted in the burner end.

Also according to the preferred method, the first fuel line is adapted to convey fuel (preferably gaseous fuel) to the first fuel nozzle in order to produce a premix main burner flame in the burner end of the burner assembly, and the conduit is adapted to convey fuel (preferably gaseous fuel) from the first fuel line to the second fuel line in order to produce a stabilizing base flame near the second fuel nozzle of the burner assembly. The preferred method also includes the steps of conveying a first portion of fuel (preferably gaseous fuel) from the first fuel line to the first fuel nozzle of the burner assembly, conveying a second portion of fuel (preferably gaseous fuel) from the first fuel line of the burner assembly to the conduit, conveying the second portion of fuel from the conduit to the second fuel line (preferably a liquid fuel line) of the burner assembly, conveying the second portion of fuel from the second fuel line of the burner assembly to the second fuel nozzle of the burner assembly, and igniting the first portion of fuel conveyed to the first fuel nozzle of the burner assembly and the second portion of fuel conveyed to the second fuel nozzle of the burner assembly.

In another preferred embodiment of the method of the invention, the second portion of fuel is conveyed by the conduit from the first fuel line to the second fuel line and the second fuel nozzle only when the burner assembly is firing in the lower portion of the range of operation of the premix main burner flame. Preferably, the second portion of fuel is conveyed by the conduit from the first fuel line to the second fuel line (and thereafter to the second fuel nozzle to produce a stabilizing base flame) only when the burner assembly is firing in the approximately lower one-third (⅓) portion of the range of operation of the premix main burner flame. In yet another preferred embodiment of the method of the invention, the second fuel line is purged before the second portion of fuel is conveyed from the conduit to the second fuel line. Preferably, the second fuel line is automatically purged by compressed air conveyed by a compressed air line which is in fluid communication with the second fuel line and controlled by the burner control system.

In operation, several advantages of the apparatus and method of the invention are achieved. For example, the first fuel line is adapted to convey a first portion of fuel (preferably gaseous fuel) to the first fuel nozzles in order to produce a premix main burner flame. The conduit is adapted to convey a second portion of the fuel conveyed by the first fuel line to the second fuel line and thereafter to the second fuel nozzle to produce a stabilizing base flame near the second fuel nozzle. The stabilizing base flame produced near the second fuel nozzle results in a more stable premix main burner flame, particularly when the burner is firing in the lower portion of the range of operation of the premix main burner flame. In addition, the stabilizing base flame results in fewer incidents of flashback and blow off by the premix main burner flame.

Further, the preferred center fuel stabilization disc enhances the mixing of stabilizing base flame fuel with main combustion air so that the stabilizing base flame may be run throughout the entire firing range of the burner without adversely affecting the quality of the combustion emissions. The preferred center fuel stabilization disc also enhances the stabilizing characteristics of the premix stabilization base flame and enables the combustion of leaner premix gas mixtures, thereby improving the stability of the base flame so that it may be run safely throughout the entire firing range of the burner, including higher main flame ranges with very lean mixtures. The preferred center fuel stabilization disc also produces a symmetrical center base flame pattern that fills any vortices produced by the main flame and improves the shape of the main flame.

The burner control system of the preferred apparatus is adapted to automatically control several elements and functions of the apparatus. For example, the preferred burner control system is adapted to automatically control the purging of fuel from the second fuel line and the flow of fuel through the conduit. More particularly, the preferred burner control system is adapted to automatically cause the compressed air line to convey compressed air to the second fuel line in order to purge fuel from the second fuel line before any fuel is conveyed from the conduit to the second fuel line. Further, the preferred burner control system is adapted to automatically cause the conduit to convey fuel to the second fuel line and thereafter to the second fuel nozzle only when the burner assembly is firing in the lower portion of the range of operation of the premix main burner flame. Still further, the preferred burner control system is adapted to automatically discontinue the flow of fuel from the conduit to the second fuel line when the burner assembly is not operating.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. An apparatus for producing a stabilizing base flame for a premix main burner flame in a burner assembly defining a center axis and having a housing, a burner end, a first fuel line, a first fuel nozzle in fluid communication with the first fuel line, a second fuel line, and a second fuel nozzle in fluid communication with the second fuel line, said apparatus comprising:

(a) a conduit having a first fuel line end and a second fuel line end, said first fuel line end being in fluid communication with the first fuel line and said second fuel line end being in fluid communication with the second fuel line;

(b) a valve in fluid communication with the conduit;

(c) a center fuel stabilization bluff body mounted in the burner end concentric to the center axis, said center fuel stabilization bluff body comprising a first ring having a first ring inner diameter and a first ring exterior diameter, a second ring having a second ring inner diameter and a second ring exterior diameter and being spaced apart from the first ring in an axial direction, and a cylinder disposed between the first ring and the second ring on each of the inner diameters of the first ring and the second ring;

wherein the first fuel line is adapted to convey fuel to the first fuel nozzle in order to produce a premix main burner flame in the burner end of the burner assembly; and wherein the conduit is adapted to convey fuel from the first fuel line to the second fuel line in order to produce a stabilizing base flame; and wherein the first ring and the second ring are disposed substantially within the burner end and the first ring exterior diameter and the second ring exterior diameter are spaced apart from the housing of the burner assembly; and wherein the first ring and the second ring are disposed substantially normal to the center axis such that fuel is introduced perpendicularly to the rings.

2. The apparatus of claim 1 wherein the first fuel line is adapted to convey gaseous fuel to the first fuel nozzle and the conduit, the second fuel line is adapted to convey liquid fuel to the second fuel nozzle, and the conduit is adapted to convey gaseous fuel from the first fuel line of the burner assembly to the second fuel line of the burner assembly.

3. The apparatus of claim 1 wherein the valve comprises a manual valve, said manual valve being adapted to manually control the flow of fuel in the conduit.

4. The apparatus of claim 1 wherein the first fuel line of the burner assembly comprises a gas safety shutoff valve and a throttling gas control valve, and the conduit is connected to the first fuel line of the burner assembly downstream from the gas safety shutoff valve and upstream from the throttling gas control valve.

5. The apparatus of claim 1 wherein a purging line is in fluid communication with the second fuel line, said purging line being adapted to purge fuel from the second fuel line of the burner assembly.

6. The apparatus of claim 1 wherein the burner assembly comprises a burner control system, said burner control system being adapted to automatically control the production of the stabilizing base flame.

7. The apparatus of claim 6 wherein the valve comprises an automatic valve, said automatic valve being adapted to be controlled by the burner control system in order to automatically control the flow of fuel in the conduit.

8. The apparatus of claim 6 wherein the burner control system automatically causes the stabilizing base flame to be produced only in the lower portion of the range of operation of the premix main burner flame.

9. The apparatus of claim 6 wherein the burner control system is adapted to automatically cause fuel to be purged from the second fuel line via a purging line.

10. An apparatus for producing a stabilizing base flame for a premix main burner flame in a premix burner assembly defining a center axis and having a housing, a burner end, a gaseous fuel line for conveying gaseous fuel, at least one gaseous fuel nozzle in fluid communication with the gaseous fuel line, a liquid fuel line for conveying liquid fuel, at least one liquid fuel nozzle in fluid communication with the liquid fuel line, and a burner control system, said apparatus comprising:

(a) a conduit having a gaseous fuel line end and a liquid fuel line end, said gaseous fuel line end of the conduit being in fluid communication with the gaseous fuel line of the burner assembly, and said liquid fuel line end of the conduit being in fluid communication with the liquid fuel line of the burner assembly, (b) a manual valve in fluid communication with the conduit, said manual valve being located between the gaseous fuel line end of the conduit and the liquid fuel line end of the conduit and being adapted to manually control the flow of gaseous fuel in the conduit;

(c) an automatic valve in fluid communication with the conduit, said automatic valve being located between the gaseous fuel line end of the conduit and the liquid fuel line end of the conduit, said automatic valve being adapted to be automatically controlled by the burner control system so as to automatically control the flow of gaseous fuel in the conduit;

(d) a center fuel stabilization bluff body mounted in the burner end concentric to the center axis, said center fuel stabilization bluff body comprising a first ring having a first ring inner circumference and a first ring exterior circumference, a second ring having a second ring inner circumference and a second ring exterior circumference and being spaced apart from the first ring in an axial direction, and a cylinder disposed between the first ring and the second ring on each of the inner circumferences of the first ring and the second ring, the first ring and the second ring being disposed substantially normal to the center axis such that fuel is introduced perpendicularly to the rings substantially within the burner end of the premix burner assembly and the first ring exterior circumference and the second ring exterior circumference being spaced apart from the housing of the premix burner assembly;

wherein the gaseous fuel line is adapted to convey to the at least one gaseous fuel nozzle a first portion of the gaseous fuel conveyed by the gaseous fuel line of the burner assembly in order to produce a premix main burner flame in the burner end of the burner assembly; and wherein the conduit is adapted to convey to the liquid fuel line a second portion of gaseous fuel conveyed by the gaseous fuel line of the burner assembly; and wherein said second portion of fuel conveyed by the conduit from the gaseous fuel line to the liquid fuel line of the burner assembly is further conveyed to the at least one liquid fuel nozzle of the burner assembly in order to produce a stabilizing base flame near the liquid fuel nozzle of the burner assembly.

11. The apparatus of claim 10 wherein the burner control system is adapted to automatically cause the stabilizing base flame to be produced only in the lower portion of the range of operation of the premix main burner flame.

12. The apparatus of claim 10 wherein the gaseous fuel line of the burner assembly comprises a gas safety shutoff valve and a throttling gas control valve, and wherein the gaseous fuel line end of the conduit is connected to the gaseous fuel line of the burner assembly downstream from the gas safety shutoff valve and upstream from the throttling gas control valve.

13. The apparatus of claim 10 wherein a purging line is in fluid communication with the liquid fuel line, said purging line being adapted to purge liquid fuel from the liquid fuel line of the burner assembly.

14. The apparatus of claim 13 wherein the burner control system is adapted to automatically control the flow of fluid in the purging line.

* * * * *